United States Patent [19]

Perry et al.

[11] 3,979,092

[45] Sept. 7, 1976

[54] SEQUENTIAL OCCUPANCY RELEASE CONTROL METHOD AND APPARATUS FOR TRAIN VEHICLES

[75] Inventors: Robert H. Perry, Canonsburg; David H. Woods, Pittsburgh, both of Pa.

[73] Assignee: Westinghouse Electric Corporation, Pittsburgh, Pa.

[22] Filed: Mar. 3, 1975

[21] Appl. No.: 554,783

[52] U.S. Cl. ..... 246/34 R; 246/187 B; 246/187 C

[51] Int. Cl.[2] ..... B61L 21/06

[58] Field of Search..... 246/77, 34 R, 34 CT, 246/167 R, 187 C, 187 B, 28 R, 122 R; 235/150.2, 150.24; 303/21 CG, 21 EB

[56] References Cited

UNITED STATES PATENTS

| | | | |
|---|---|---|---|
| 3,251,990 | 5/1966 | Luhrs | 246/167 R |
| 3,886,515 | 5/1975 | Cottin | 235/150.2 |
| 3,887,152 | 6/1975 | Eblovi | 246/34 R |
| 3,891,167 | 6/1975 | Perry | 246/34 R |

*Primary Examiner*—George E. A. Halvosa
*Assistant Examiner*—Reinhard J. Eisenzopf
*Attorney, Agent, or Firm*—R. G. Brodahl

[57] ABSTRACT

An improved train vehicle speed control system is provided for operation in conjunction with train speed control signals and train occupancy indication signals in relation to a train vehicle track system including a plurality of predetermined track circuit signal blocks through which train vehicles pass. It is desired that a control of train vehicle speed be provided in relation to the detected occupancy by a train vehicle of a particular signal block, for maintaining train vehicle occupancy protection requirements and providing desired sequential occupancy control of the train vehicles through each of successive signal blocks through operation of provided protection signals with selected signal blocks behind the detected train vehicle. Spurious pseudo vehicle occupancy in a given signal block is detected and included in the provided train speed control in relation to that given signal block.

28 Claims, 24 Drawing Figures

| | N-2 | N-1 | N | N+1 | N+2 | N+3 | N+4 |
|---|---|---|---|---|---|---|---|
| 1 | I,Q | I | | I,B | | | |
| 2 | Q | I | | I,B | | | |
| 3 | | I,Q | I | I,B | | | |
| 4 | | Q | I | I,B | | | |
| 5 | | Q | | I,B | | | |
| 6 | | | | I,B,Q | I | | |
| 7 | | | | I,B | I,Q | I | |
| 8 | | | | I,B | Q | I | |
| 9 | | | | I,B | | I,Q | I |
| 10 | | | | | | Q | I |

SEQUENTIAL OCCUPANCY RELEASE CONTROL METHOD AND APPARATUS FOR TRAIN VEHICLES

CROSS REFERENCE TO RELATED APPLICATION

The present application is related to a concurrently filed patent application Ser. No. 554,781 and filed Mar. 3, 1975 by N. A. Brumberger et al and entitled "Sequential Occupancy Release Control Method and Apparatus for Train Vehicles", which is assigned to the same assignee as the present application, and the disclosure of that related patent application is incorporated by reference into the present application.

BACKGROUND OF THE INVENTION

It is known in the prior art to control the movement of one or more vehicles coupled together to form a train through a fixed block track circuit signaling system. Specific signal blocks of track are established by predetermined very low impedance electrical signal boundaries provided at the ends of each signal block. When a train vehicle is present in a given signal block, at least one vehicle axle of the train electrically shorts between the two conductive track rails on which the vehicle runs. A signal transmitter is coupled to the track at one end of each signal block and a cooperative signal receiver is coupled to the track at the opposite end of that signal block for providing desired control of the train movement and detecting the occupancy of a train vehicle within that signal block. The train position is detected electrically as the individual vehicles of the train move along the track rails, passing through succeeding blocks, as described in U.S. Pat. RE No. 27,472 of G. M. Thorne-Booth and as described in an article published in the Westinghouse Engineer for September, 1972 at pages 145 to 151 by R. C. Hoyler.

The vehicle detection equipment is located at the wayside of the track, and when a train vehicle is detected in a given signal block, a control signal is provided to influence the speed code of the next previous signal block and if desired this control signal can ripple back to one or more previous signal blocks. Under certain abnormal operational conditions, such as when electric power to the train vehicle is lost or when a substantial corrosion film or ice builds up on the top of the track rail members, there is a small possibility that the conventional signaling system may not detect a train vehicle occupancy within a given signal block. The conventional signaling system detects the train vehicle shunt impedance, and if this is abnormally high for some reason the train vehicle occupancy detection becomes more difficult. An excessive corrosion film will increase the train vehicle shunt impedance by forming a barrier layer to make more difficult the detection of the train vehicle occupancy.

The need for sensing train vehicle presence in a given present signal block has led to occupancy detection and sequential occupancy release control of train movement, such that when a vehicle occupancy is detected in a present signal block it is necessary to subsequently detect occupancy in the next succeeding signal block before a release is desired of the occupancy behind the vehicle. The occupancy in a previous signal block is retained and not released until the train vehicle occupancy is positively detailed in the next succeeding signal block.

It is known in the prior art as generally described at page 51 of Business Week magazine for Mar. 2, 1974 to determine the occupancy detection and sequential occupancy release control of a train vehicle moving in relation to successive signal blocks N−2, N−1, N, N+1, and N+2 and so forth by utilizing the following train movement control algorithms:

$$\text{Set } O_N = Q_{N-1}\left[\overline{Q}_{N+1}I_{N+1}\left(\overline{B}_{N+1}+\overline{Q}_{N+2}I_{N+2}\left(\overline{B}_{N+2}+\overline{Q}_{N+3}\cdots\right.\right.\right. \text{, etc.} \quad (1).$$

$$\text{Reset } Q_N = Q_{N+1} \quad (2).$$

$$\text{Set } B_N = I_N\overline{Q}_N\overline{Q}_{N-1}\left[\overline{Q}_{N-2}\left(\overline{B}_{N-1}+\overline{Q}_{N-3}\left(\overline{B}_{N-2}+\overline{Q}_{N-4}\cdots\right.\right.\right. \text{ etc.} \quad (3).$$

$$\text{Reset } B_N = \overline{I}_N \quad (4).$$

$$O_N = I_N + Q_N \quad (5).$$

where $I_N$ is a primary train vehicle occupancy indication signal for a typical signal block N, $Q_N$ is a back up protection signal for signal block N, $B_N$ is a pseudo or false occupancy indication signal for block N and $O_N$ is the occupancy control signal operative with the primary train control system for signal block N. The $O_N$ signal controls the movement of a subsequent train vehicle in relation to previous signal block N−1 when a train vehicle is detected within present signal block N. The above set $Q_N$ equation (1) is operative with the indicated well known AND and OR logic relationships to set the signal $Q_N$ to true when the signal $Q_{N-1}$ is true and the not signal $\overline{Q}_{N+1}$ is true and the signal $I_{N+1}$ is true and the not signal $\overline{B}_{N+1}$ is true. In addition, the OR operation of the above said $Q_N$ equation (1) is operative to set the signal $Q_N$ to true when the not signal $\overline{B}_{N-1}$ is a false, if the signal $Q_{N-1}$ is true and the not signal $\overline{Q}_{N+1}$ is a true and the signal $I_{N+1}$ is a true and the not signal $\overline{Q}_{N+2}$ is true and the signal $I_{N+2}$ is true and the not signal $\overline{B}_{N+2}$ is true, and so forth for all of the remaining track signal blocks ahead of block N, up to a theoretical infinite number of signal blocks. In general a false signal has a zero volts value and a true signal has a predetermined volts value. The above reset $Q_N$ equation (2) is operative to reset the signal $Q_N$ to a false when the signal $Q_{N+1}$ is true. The above set $B_N$ equation (3) is operative with well known logic relationships to set the signal $B_N$ to true when the occupancy indication signal $I_N$ is true and the not signal $\overline{Q}_N$ is true and the not signal $\overline{Q}_{N-1}$ is true and the not signal $\overline{Q}_{N-2}$ is true and the not signal $\overline{B}_{N-1}$ is true. In addition the OR operation of the above said $B_N$ equation (3) is operative to set signal $B_N$ to true if not signal $\overline{B}_{N-1}$ is false, when signal $I_N$ is true and the not signal $\overline{Q}_N$ is true and the not signal $\overline{Q}_{N-1}$ is true and the not signal $\overline{Q}_{N-2}$ is true and the not signal $\overline{Q}_{N-3}$ is true and the not signal $\overline{B}_{N-2}$ is true, and so forth for all of the remaining track signal blocks subsequent to block N up to a theoretical infinite number of signal blocks. The above reset $B_N$ equation (4) is operative to reset signal $B_N$ to false when the not signal condition $\overline{I}_N$ is true. The above said set $O_N$ equation (5) is operative to set the occupancy control signal $O_N$ to true when the signal $I_N$ is true or the signal $Q_N$ is true.

SUMMARY OF THE PRESENT INVENTION

In accordance with the present invention, a sequential occupancy release control method and apparatus for train vehicles is provided having an improved operation for protecting against loss of signal block vehicle occupancy detection and for protecting a given train of vehicles in relation to a subsequent train of vehicles as well as in relation to predetermined activities such as track switch operations involving that same given train of vehicles. Detection of a spurious vehicle occupancy signal is provided, and desired train vehicle control is enabled in relation to such a spurious or pseudo occupancy signal. An occupancy protection signal Q is set in relation to each of a predetermined number of track signal blocks previous to or adjacent to a present signal block where a train vehicle occupancy has been established, depending upon the length of these adjacent signal blocks in relation to a predetermined maximum length of a train of vehicles, and this protection signal is reset only after the train vehicle occupancy has been established in a new signal block ahead of the present signal block. In addition, an improved pseudo occupancy signal B is set in relation to a signal block where the train vehicle occupancy has been indicated erroneously and it is established that a train vehicle does not in fact occupy the latter signal block.

Figure 22:
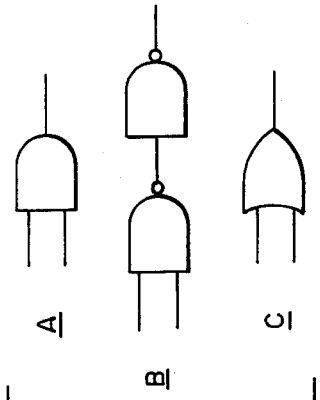
FIG.22 PRIOR ART
Figure 23:
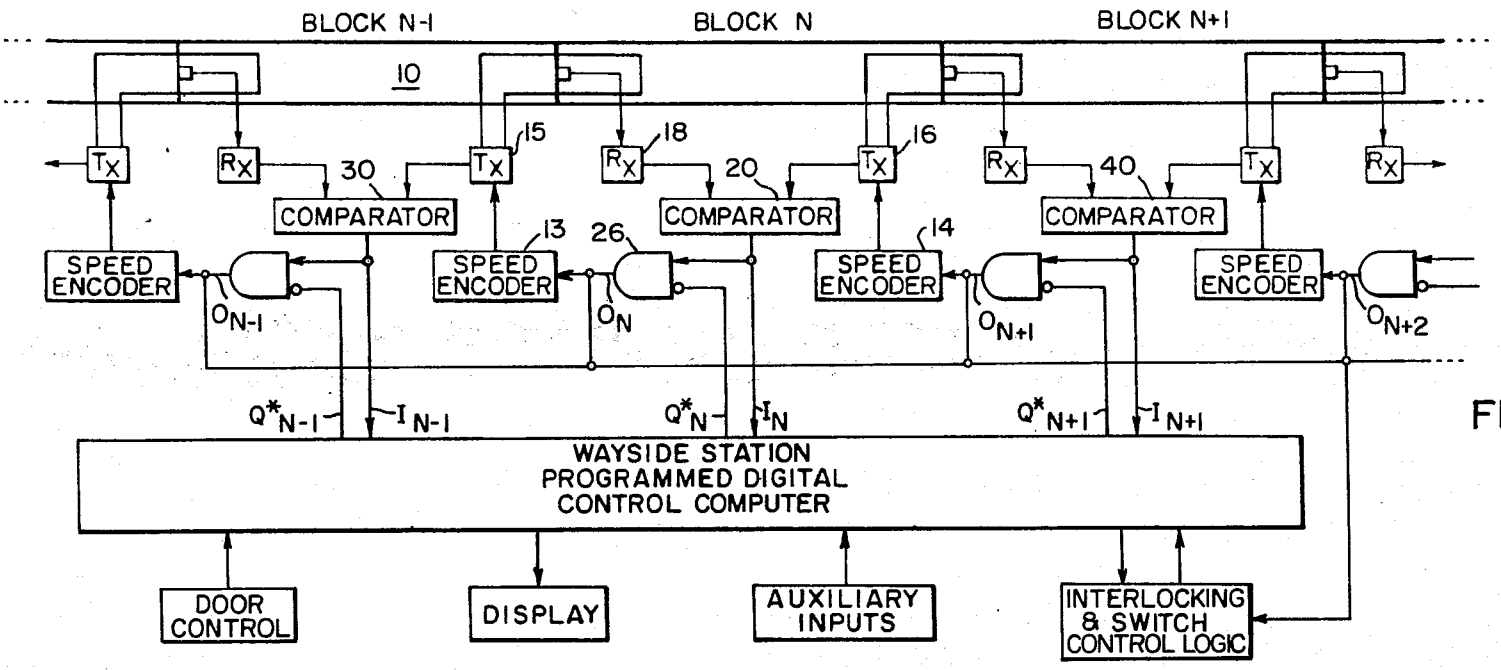

FIB. 21B illustrates the sequential occupancy release operation of the present invention in relation to a train vehicle merge situation;

FIG. 22 illustrates the well known functional equivalency between a negative logic OR device, two series connected NAND devices and a positive logic AND device; and FIG. 23 illustrates a digital control computer including a control program operative for controlling the movement of a train vehicle in accordance with the present invention.

DETAILED DESCRIPTION OF THE PRESENT INVENTION

Figure 1:
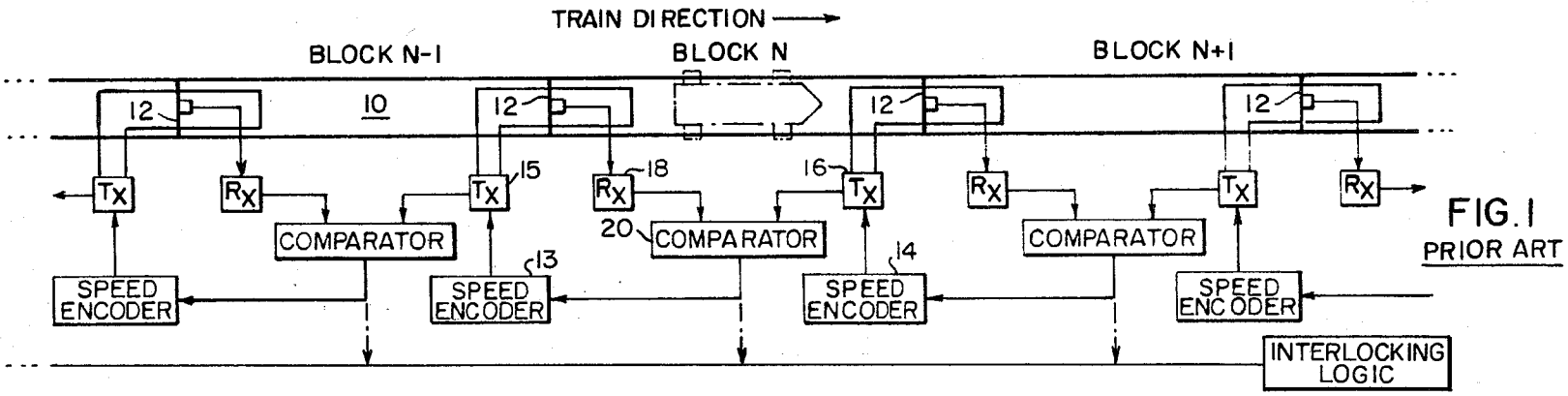
FIG. 1 PRIOR ART
FIG. 1 is a schematic showing a prior art train control system including track circuit signal blocks operative for sensing of the presence of occupancy of a train vehicle in relation to each of successive signal blocks, such as N—1, N and N+1.

In FIG. 1 there is shown a train control system, including a track 10 provided with electrically conducting short circuit members 12 for dividing the track 10 into a plurality of successive signal blocks, such as illustrated by N—1, N and N+1. Normal speed command signals from a speed encoder 14 are supplied to a transmitter 16 coupled to the signal block N such that a receiver 18 is operative to receive a desired or normal speed command signal through the track when a train vehicle is not present within block N, and such that the receiver 18 does not receive the speed command signal when a train vehicle occupies the signal block N and provides an electrical short circuit to prevent the transmitted speed command signal from the transmitter 16 from passing through the signal block N to the receiver 18, such as known in the prior art and described in U.S. Pat. Reissue No. 27,472 above referenced and as described in an article published in the Westinghouse Engineer for Sept. 1972 at pages 145 to 151.

Figure 2:
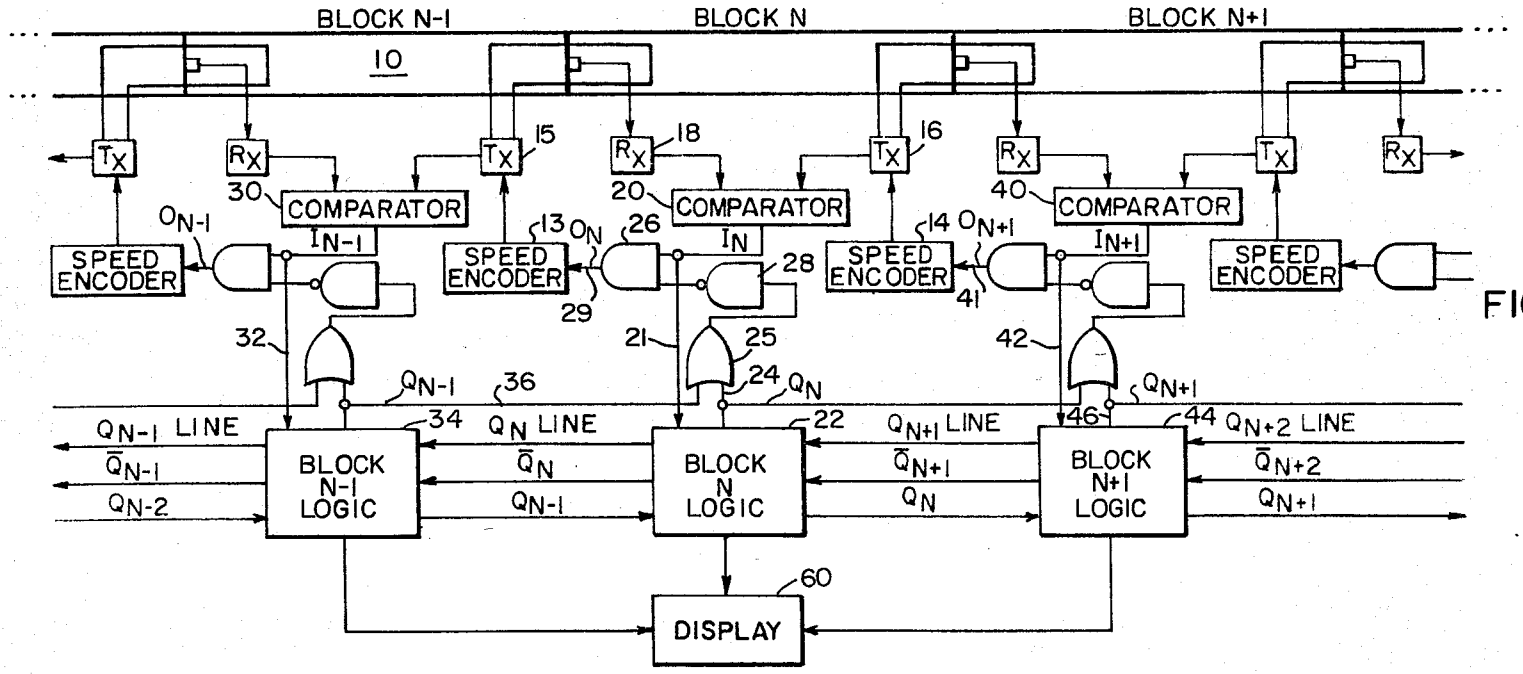
FIG. 2 is a schematic showing of the present train control system including the improved sequential occupancy control of a train of vehicles passing through each of successive signal blocks, such as illustrative signal blocks N—1; N and N+1.

In FIG. 2 there is shown the present train control system including the improved sequential occupancy release control of the present invention operative in accordance with negative logic operations, in relation to a train of vehicles passing through each of successive signal blocks N—1, N and N+1. There is provided for each of these signal blocks a speed encoder, a transmitter and a receiver such as described in relation to FIG. 1, and a comparator operative to compare the transmitted signal from the transmitter with the received signal from the receiver for each signal block for providing an occupancy indication signal, such as signal $I_N$ which is true in negative logic terms, when a vehicle occupies signal block N and which is applied to the speed encoder 13 for block N−1 for controlling the operation of the transmitter 15 of block N−1. The block N logic circuit 22 is operative with the occupancy indication signal $I_{N+1}$ and logical information along $Q_{N+1}$ line for providing a protection signal $Q_N$ on line 24 in accordance with the above set $Q_N$ equation (1). The block N logic circuit 22 will be described in greater detail in relation to the showing of FIG. 3. It should be noted that the comparator 30 operative with block N−1 provides a true occupancy indication signal $I_{N-1}$ on line 32 to the block N−1 logic circuit 34 when a vehicle is detected within signal block N−1. The comparator 40 operative with the block N+1 provides a true occupancy indication signal $I_{N+1}$ when a train vehicle is detected within block N+1, which occupancy indication signal $I_{N+1}$ is supplied over line 42 to the block N+1 logic circuit 44. The block N−1 logic circuit 34 and the block N+1 logic circuit 44 as well as the block N logic circuit 22 are each operative in accordance with the above set Q equation (1) for respectively providing a true protection signal $Q_{N-1}$ over line 36 when a train vehicle is detected within block N, for providing a true protection signal $Q_N$ on line 24 when a train vehicle is detected within block N+1 and for providing a true protection signal $Q_{N+1}$ over line 46 when a train vehicle is detected within block N+2. A suitable information display 60 is provided to display desired information for the system operating and maintenance personnel and operative with each of the block N−1 logic circuit 34, the block N logic circuit 22 and the block N+1 logic circuit 44, as shown.

When the train is detected in signal block N+1 to provide a true occupancy indication signal $I_{N+1}$ from the comparator 40, it is necessary to establish a true protection signal $Q_N$ in relation to controlling the speed code for the previous signal blocks N and N−1. This protection $Q_N$ signal when true indicates that not only is the block N+1 occupied, but also it forces an occupancy in the block N behind the block N+1 where the actual train vehicle is detected. As the train passes between adjacent signal block N and N+1 the occupancy indication signals $I_N$ and $I_{N+1}$ will both be true since the train may be in the order of 700 feet or 213.35 meters long, when this is the predetermined maximum train length, and the trailing part of the train will overlap both signal blocks. If part of the train is seen in block N and part of the train is seen in block N+1, the protection signal $Q_N$ will be latched true in block N and $Q_{N-1}$ will be reset false. As soon as the train is detected in block N+1 the protection signal $O_{N+1}$ on line 41 is set true to control the speed code signals provided by speed encoder 14 in block N. In addition the signal $O_N$ on line 29 is set true as a result of $Q_N$ on line 24 operating with AND device 26 to control the speed code signals provided by speed encoder 13 in signal block N−1.

It should be noted that the above train movement control equations (1), (2), (3) and (4) are written to illustrate the train control operation for a time when a train vehicle is detected in signal block N. When a train vehicle is detected in another signal block, such as in the next succeeding block N+1, the equations (1), (2), (3) and (4) are operative with that latter signal block accordingly.

Under certain abnormal conditions of real time operations, the prior art train control systems might respond with unusual noise in the wayside equipment and some track conditions and may produce spurious noise signals, or as the result of a failure, a permanent signal indicating an occupancy signal $I_N$ which would be a pseudo occupancy situation where no train vehicle is actually present in the signal block N. At this time, the pseudo occupancy signal $B_N$ is set true resulting from the provision of the true occupancy indication signal $I_N$ without the simultaneous provision of the true train protection signal $Q_{N-1}$ behind the signal block N. Some signal block receivers, such as receiver 18, may provide a true occupancy indication signal I and the prior art control system would indicate the presence of a train in the corresponding signal block, such as signal block N. When a subsequent train eventually arrives in the next previous signal block N−1, the train stops in signal block N−1 as if there were a real train actually located in the next signal block N, which is the desired and safe condition of train system operation. If a true or zero volt occupancy indication signal $I_N$ is provided with no other signals being presented in relation to the other signal blocks adjacent to the signal block N this is a false occupancy situation, and the prior art train control system would stop a subsequent train in signal block N−1 and the human train operator would have to contact the central station dispatcher to indicate that an apparent occupancy existed ahead of signal block N−1 since his train is receiving a zero speed command signal block N−1. The central dispatcher would then give the train operator permission to go through the signal block N under manual control until the train again received a normal speed code signal in a succeeding signal block, such as signal block N+1 and the central dispatcher would then permit continued automatic train operation thereafter.

The train vehicle protection equations in accordance with the present invention have been operationally improved such that the set B signal relationship is as follows:

$$\text{Set } B_N = I_N(d) \cdot \overline{Q_{N-1}} \cdot \overline{Q_N} \qquad 6.$$

and the improved set $O_N$ signal equation is as follows:

$$O_N{}^* = I_N{}^* + Q_N + Q_{N-1} \qquad 7.$$

where the $I_N(d$signal is the $I_N$ signal delayed by an additional amount in the order of 1 second ±2/10 of a second and the signals $O_N{}^*$ and $I_N{}^*$ are vital control signals to maintain the present fail safe train control in relation to the desired safety of train operation.

Figure 3:
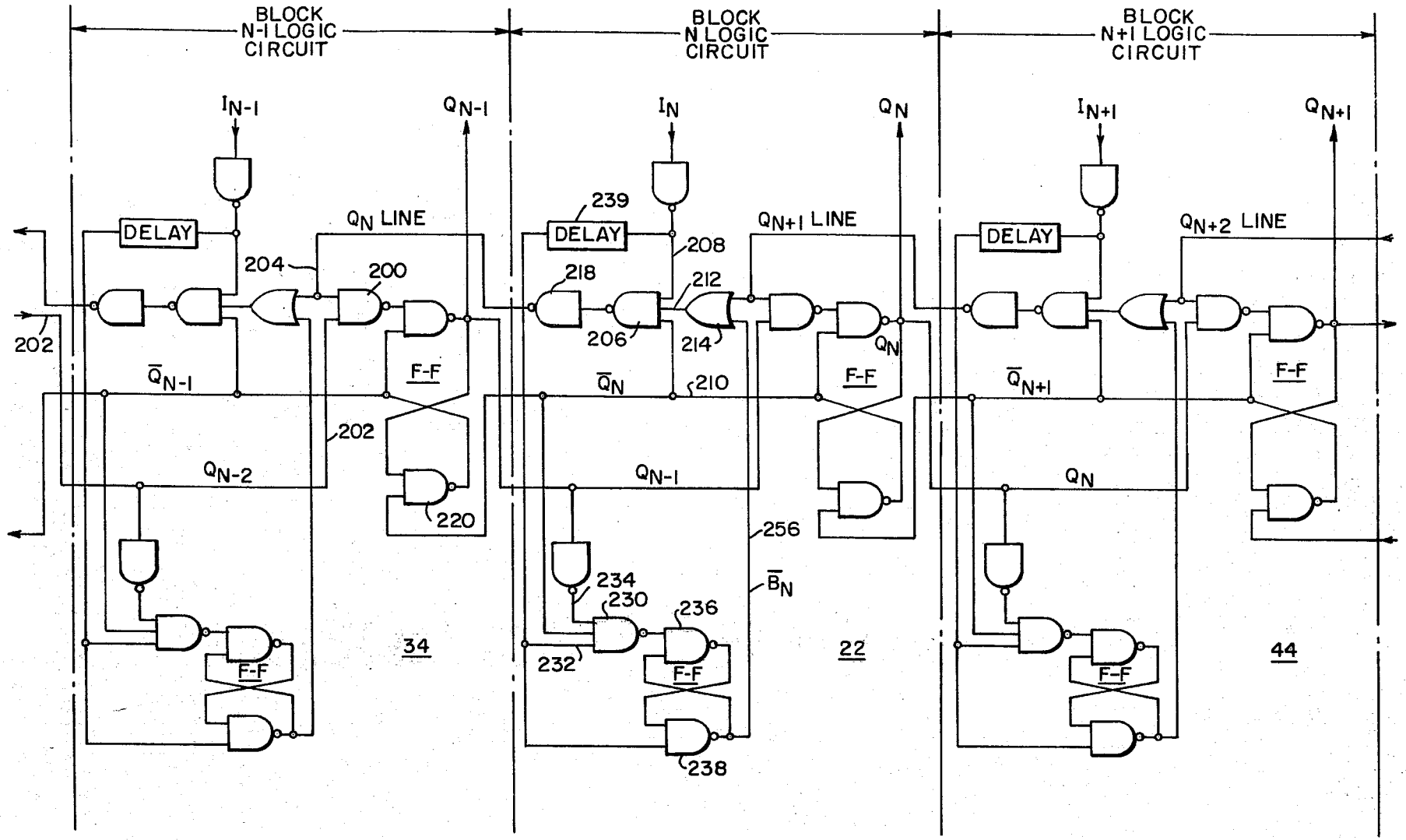
FIG. 3 illustrates a suitable logic operation provided for the present train control system shown in FIG. 2.

The present control system determines when a pseudo occupancy situation is present because the occupancy indication signal $I_N$ is provided true without a train movement associated true protection signal $Q_{N-1}$ behind it. Provision of the true occupancy indication signal $I_N$ without a true protection signal $Q_{N-1}$ for the previous signal block indicates a pseudo or fictitious false occupancy condition of train operation. The pseudo occupancy signal $B_N$ is set true in accordance with the above equation (6) when occupancy indication signal $I_N$ is provided true and not the true protection signal $Q_{N-1}$ to indicate there is history of a train vehicle coming through the previous signal block N−1 and not the true protection signal $Q_N$ which indicates there is no valid train vehicle overlap into block N from the succeeding signal block N+1. The occupancy indication signal $I_N$ delayed is provided with a predetermined time delay as shown in FIG. 3 to get around logical race conditions in relation to a train vehicle traversing a given signal block and setting the protection signal Q true for the next previous signal block and then resetting the protection signal Q false trailing behind the train. The delay permits the protection signal Q to reshuffle which only takes a few microseconds, but this allows more than enough time to reshuffle the protection Q signal before looking at the set $B_N$ equation (6). In addition the delay is of sufficient length to exclude short occupancy indications resulting from logic disagreements in the prior art hardware which not infrequently produce short occupancy indications.

Before setting the pseudo occupancy signal $B_N$ the above equation (6) looks for the true occupancy indication signal $I_N$ and the false protection signal $Q_{N-1}$ to establish a history through the signal blocks including block N. When there is provided a true occupancy indication signal $I_N$ and a false protection signal $Q_{N-1}$, the latter condition can occur at the time when a train is moving across the boundary between signal blocks N and N+1, so the equation (6) also looks for a false protection signal $Q_N$ whenever a true occupancy indication signal $I_N$ has appeared.

For any signal block train occupancy condition where there is sensed a true occupancy indication signal I, the set $B_N$ equation (6) determines that the occupancy indication $I_N$ signal, which is true to indicate vehicle occupancy, is invalid if the protection Q signal in the previous block N−1 is not set true to indicate there is no valid entry of the train vehicle into the signal block N. When the train vehicle crosses the boundary into the next signal block N+1 this could wipe out the protection signal $Q_{N-1}$ but if the train is crossing the boundary into the signal block N+1 and a valid occupancy indication $I_{N+1}$ signal is provided, the above set $Q_N$ equation (1) will give a true protection $Q_N$ signal. Thusly when the control system operates to set the pseudo occupancy signal $B_N$ to a true value, this indicates something about the occupancy indication signal $I_N$ that was not known before, namely it is a pseudo or false occupancy situation. The sequential occupancy control system is trying to carry at least one set protection Q signal through the track system behind the train and provides this piece of pseudo occupancy B signal information for the set $Q_N$ equation. The present control system provides this desired memory feature and protects a given train from behind at all times regardless of what is the actual train occupancy situation.

As shown in FIG. 2 when a train vehicle is detected in block N+1 the true occupancy indication signal $I_{N+1}$ is provided over line 42 which causes the block N+1 logic circuit 44 to set true the $Q_{N+1}$ line signal which is supplied over line 25 to the block N logic circuit 22. The protection $Q_N$ signal is now set to true by the block N logic circuit 22 and supplied over line 24 to the OR device 26 for applying a zero signal to the speed encoder 13 for preventing the normal speed code in signal block N−1 and providing an arbitrary zero speed code instead. Thusly, it should be understood that when a train vehicle is present in any of the signal blocks N−1, N or N+1, the respective comparator 30, 20 or 40 operative with that signal block will provide a true output signal to prevent a normal speed code in the previous signal block, and will provide the true value occupancy indication signal I, which for the case of block N−1 is the $I_{N-1}$ signal, for the case of the block N is the $I_N$ signal and for the case of block N+1 is the $I_{N+1}$ signal. Thusly when a train is sensed in the signal block N+1, a true occupancy indication signal $I_{N+1}$ is provided to set to true the $Q_N$ protection signal, and this results in a zero value signal provided by the AND device 26, to the speed encoder 13 and is the same in function as though a zero value occupancy indication signal $I_N$ had been supplied by the comparator 20; thusly, the output of AND device 26 prevents any normal speed code signals in the signal block N−1 and is equivalent to having a true occupancy indication signal $I_N$ as if a train were present in the signal block N.

When a train vehicle is present in block N as shown in FIG. 2, the illustrated track wayside equipment senses the presence of the train vehicle to provide a true occupancy indication signal $I_N$ which is fed back to the speed encoder 13 for the block N−1 to provide a zero speed signal for the block N−1, and additionally the true occupancy indication signal $I_N$ is operative to set the $Q_{N-1}$ protection signal true in accordance with equation (1) to cause the block N−1 logic circuit 34 to provide the true protection signal $Q_{N-1}$ which causes the speed encoder for the signal block N−2 (not shown) to provide a zero speed code signal to the signal block N−2.

Thusly, the schematic showing of the train control system in FIG. 2, in relation to the signal block N, illustrates a determination of what vehicle movement operating conditions are behind the signal block N as well as ahead of the signal block N for a given train to move along the track and in relation to the train operation controlling relationships set forth in the above equations. It may be necessary under certain operational situations to provide a protection of the train by the human train operator or by a central station control computer, for example when a special signal operation is desired for entering a train into a section of track operative with the here described control system. The set $Q_N$ equation (1) operates to set $Q_N$ to a true when a true protection signal $Q_{N-1}$ has been manually provided and a true value not pseudo occupancy signal $\overline{B}_{N+1}$ which are the equation terms requiring satisfaction, when no train occupies the signal block N+1. Conversely when the train reaches the other end of the track system and it is desired to reverse the train direction, again the train operator or a central station control computer must generate the suitable signals when the train reverses its direction of operation and moves down the parallel track in the opposite direction; thusly, safe forward train movement is permitted in relation to signal block N by the presence of true protection signal $Q_{N-1}$, not having the true pseudo occupancy signal $\overline{B}_{N+1}$, not having the true protection signal $Q_{N+1}$ and providing the true occupancy indication signal $I_N$. The typical train operation is to move along a first track from a first end of a given track system to the opposite end of that first track, where the train stops and reverses operation by the operator moving to the opposite end of the train and controlling the train through a crossover switch such that the train then proceeds back along a parallel and second track to the first end of the track system where the same operator procedure to reverse the train movement again takes place. At the end of a given run along the track, when the train in effect reverses its direction of operation, the train control apparatus must also be turned around in its operation orientation since otherwise there would be a true protection Q signal that was previously behind the train but is now ahead of the train to prevent the same train from moving in a reverse direction along the track. The true protection Q signal is always one signal block behind the moving train and the operator now has to remove this set true protective signal. The teachings of the present invention are primarily related to the controlled and normal forward movement of a passenger carrying transit train vehicle, with sequential occupancy release control provided for the train vehicle in relation to successive and predetermined signal blocks. As shown in FIG. 2 the occupancy control signal $O_N$ on lead 29 is established true as an OR function of the true occupancy indication signal $I_N$ on lead 21 or the true protection signal $Q_N$ on lead 24 operative with the OR device 26. In addition the true protection signal $Q_{N-1}$ supplied by the block N−1 logic circuit 34 on lead 36 can be applied to the OR device 26 such that the occupancy control signal $O_N$ is determined at the terminal 29 for controlling the operation of speed encoder 13.

It should be understood that the present train control system can be operative with either one of rear end sensing or front end sensing of the train in relation to the definition of the occupancy indication signal $I_N$. For example, if the occupancy indication signal $I_N$ becomes true for the purpose of controlling the back up system only when the rear end of the train leaves the signal block N, then this is rear end sensing control. On the other hand, if the occupancy indication signal $I_N$ becomes true when the front end of a given train of vehicles enters the signal block N, this is a front end sensing control system in relation to the control of block logic elements 34, 22, 44 and hence the train movement.

The operation of the signal block N logic circuit 22, the signal block N−1 logic circuit 34 and the signal block N+1 logic circuit 44 as shown in FIG. 3 will now be explained in relation to the above train control equations for a train vehicle entering the signal block N. The set $Q_{N-1}$ above equation (1) is operative with the provided occupancy indication signal $I_N$ when the train vehicle enters a signal block N to set true the protection signal $Q_{N-1}$ in the following manner. The NAND gate 200 within the block N−1 logic circuit 34 senses the true protection signal $Q_{N-2}$ supplied by the conductor 202 from a previous block N−2 logic circuit (not shown) because of the passage of the train through previous signal block N−1 or because the operator has provided a fictitious Q protection signal to the block N−2 logic circuit for the purpose of initiating the operation of the train control system as shown in FIG. 3. The conductor 204 supplies the $Q_N$ line signal which corresponds to the portion $(\overline{Q}_N \cdot I_N \cdot \overline{B}_N)$ of the above $SQ_{N-1}$ equation (1). The NAND gate 206 within the block N logic circuit 22 provides this $Q_N$ line signal on conductor 204 as an AND logic operation by sensing the true occupancy indication signal $I_N$ on conductor 208, sensing the not protection signal $\overline{Q}_N$ supplied on conductor 210 and the not pseudo occupancy signal $B_N$ supplied on conductor 212 from the OR gate 214 and the conductor 216 with the $B_N$ signal from the NAND gate 238. The NAND element 218 is provided to invert the $Q_N$ line signal since the output of NAND gate 206 is negative and the input to NAND gate 200 is required to be positive. The NAND gate 220 shown in the block N−1 logic circuit 34 is operative to reset the protection $Q_{N-1}$ signal false when the not protection $\overline{Q}_N$ signal is supplied on conductor 210, noting that negative logic is illustrated. The above set $B_N$ equation (6) is operative in relation to NAND gate 230 in response to the delay occupancy indication signal $I_N(d)$ supplied on conductor 232 from the delay 239 and the not protection $\overline{Q}_{N-1}$ signal supplied on conductor 234 and the not $\overline{Q}_N$ protection signal supplied on conductor 210. The reset $B_N$ operation of the above equation (4) is provided by NAND gate 238 responding to the absence of the occupancy indication signal $I_N(d)$ or the (not) $\overline{I}_N(d)$ signal.

The positive logic convention is used in relation to the logic operation diagram of FIG. 3, where all true states are understood to be a logic one, and in the circuit this refers to the high voltage output potential. The false state in this respect is a logic 'zero', or the low voltage condition within the circuit.

In the system application the signals at the interface may be required to be other than a true output, i.e., in 'negative logic terms'. To anyone skilled in this particular art these signals can be inverted where appropriate or the application can be changed as desired to suit the actual hardware to be used, such as shown by the negative logic OR device 26 shown in FIG. 22. The negative logic OR device shown in FIG. 22 is the functional equivalent of the series connected NAND devices with negative logic convention, and is the functional equivalent of the single noninverting AND, as well known in this art.

Referring now to the logic circuit given in FIG. 3. The initial conditions for these blocks are with a train vehicle present in block N−1 and no protective Q signals or pseudo occupancy B signals set in any of the three signal blocks. A protective Q signal will be present in block N−2. Outputs from NAND devices 248, 242, 252 and 236 will be zero, and outputs from NAND devices 220, 244, 254 and 238 will be one.

As the train crosses the boundary between block N and block N−1, occupancy indication signal $I_N$ goes to a logic zero or true state. This is a negative logic convention signal since in the primary occupancy system for the purpose of failsafe train control an occupancy results in the loss of a signal. This convention arises out of passenger and vehicle safety considerations. However, device 250 immediately inverts the signal to a one signal on line 208.

$$\text{Consider } SQ_{N-1} = Q_{N-2}\left[\cdot\ \overline{Q}_N \cdot \underbrace{I_N(\overline{B}_N + \overline{Q}_{N+1}}_{A} \cdot I_{N+1} \qquad \text{(Eq. 1)}$$

That part designated A is now satisfied as follows:

$Q_{N-2}$ is a one as defined and seen on line 202.

$\overline{Q}_N$ is a one as supplied by device 244 on line 210.

$I_N$ is a one on line 208.

$\overline{B}_N$ is a one as supplied by device 238 on line 256.

The signals $\overline{Q}_N$, $I_N$ and $\overline{B}_N$ are ANDed at the input to device 206 and because this is a NAND gate the output will be a zero. This is then inverted to a one by device 218 and presented as one input to device 200. The remaining input to NAND device 200 is the signal $Q_{N-2}$ on line 202. Because of the NAND logic function of device 200, the output will be a zero. The output of device 248 is now forced to a one, which is one of two inputs to device 220. The other input is also a one (i.e., device 244 output being a one and signifying $\overline{Q}_N$) which allows output of 220 to go to zero. This in turn latches 248 in the one output state, and anyone skilled in the art will recognize this as a conventional flip-flop. The $Q_{N-1}$ signal is now set and provides the $Q_{N-1}$ input to device 240. By well known convention, the set condition of the flip-flop refers to the Q signal output being a true or a one signal. $Q_N$ will not set since line 260 is carrying a zero from the Q line of logic associated with N+1.

$Q_N$ will set after the $Q_{N+1}$ line 260 goes to a one state after the train moves into and is detected in block N+1. When $Q_N$ is set, line 210 will have a logic zero present as an input to device 220. This zero will force a one at the output. Line 210 being zero will also appear as an input to device 206 and in turn a zero output from 218. $Q_{N-2}$ was reset in response to $Q_{N-1}$ being set earlier. The output of 200 is therefore a one. Flip-flop 248/220 remains set until the input to 220 on line 210 mentioned above goes to zero. At this time, the inputs to NAND device 248 are both one setting the output to zero and now latching this $Q_{N-1}$ flip-flop in the reset condition. This operation satisfies above equation (2) which is $RQ_{N-1} = Q_N$.

$Q_{N+1}$ will set and $Q_N$ will reset as the result of the same sequence when the train is detected in N+2.

Now consider the case where before a train appears in block N−1 a false occupancy is present in N. The output of device 250 is one which after a suitable delay appears as a one input on line 232 to device 230. No $Q_{N-1}$ signal is present, therefore, a zero input to device 262 results in a one output on line 234 as an input to 230.

The $Q_N$ signal also is in the false state, hence a one on line 210 is the third one input to 230 whose output will now be a zero forcing a one output from device 236. Devices 236 and 238 form a flip-flop supplying the pseudo or false occupancy $\overline{B_N}$ term on line 256. This $\overline{B_N}$ term is now zero and is an input to device 214. The other input (line 260) is also zero, hence the output on 212 is zero forcing a one output from 206 and a zero output from 218. This latter zero on line 204 prevents signal $Q_{N-1}$ from setting. As a train enters block N−1, the signal $Q_{N-2}$ is set as before. When the train enters block N, the signal $Q_{N-1}$ is not set because the $B_N$ flip-flop has been set. Instead, the train will move on into block N+1 where the $Q_{N+1}$ line 260 will now have a one present as an input to 214, and device 214 outputs a one into 206, which in turn then causes $Q_N$ line 204 to go to a one state. Device 248 will now output a one as before. Since line 260 is a one, the appearance of a one on line 258 now immediately causes signal $Q_N$ to set and device 242 to output a one. The zero output from device 244 resets signal $Q_{N-1}$, whereby device 248 outputs a one. The $B_N$ flip-flop remains unchanged.

The signal Q now continues on through the system as before.

Figures 4, 5:
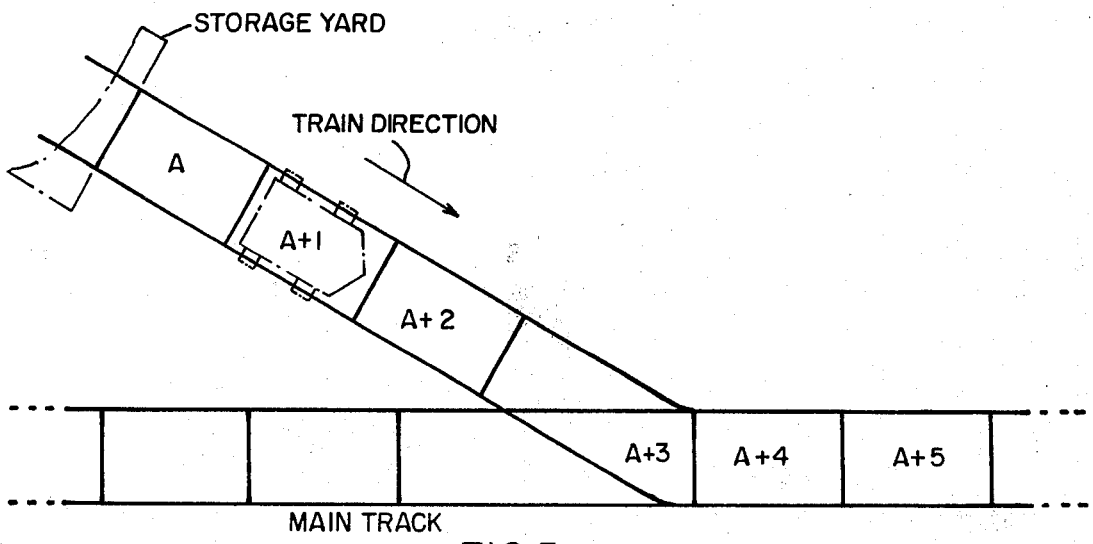
FIG. 4 is an illustrative table of provided occupancy indication I signals, protection Q signals and pseudo occupancy B signals provided by the present train control system in relation to at least one train vehicle moving through successive signal blocks N—2 through N+4.
FIG. 5 shows a diagram of the track arrangement for a system entry operation of at least one train vehicle.

In FIG. 4 there is shown an illustrative table of occupancy indication signals I, protection signals Q and pseudo occupancy signals B provided by the present train control method and apparatus in relation to the movement of a train of vehicles through a section of track, including signal block N−2 and ending with signal block N+4. Line 1 of the table illustrates the train position where the train spans the signal block N−2 and the signal block N−1, with the true occupancy indication signal $I_{N-2}$ and the true occupancy indication signal $I_{N-1}$ being provided and the true protection signal $Q_{N-2}$ being provided in relation to the true occupancy indication signal $I_{N-1}$. It should be noted that there is in addition an erroneous true occupancy indication signal $I_{N+1}$ and a true pseudo occupancy signal $B_{N+1}$ provided to illustrate a pseudo or false occupancy situation where a train vehicle is de facto not present in signal clock N+1 but an erroneous true signal $I_{N+1}$ is provided. The second line of the table illustrates the train movement completely into signal block N−1 such that the true occupancy indication signal $I_{N-1}$ is provided, as well as the true protection signal $Q_{N-2}$ remaining with the N−2 signal block for protecting the rear of the train, with the erroneous true occupancy indication signal $I_{N+1}$ and the true pseudo occupancy signal $B_{N+1}$ still being provided. In the third line of the table the train position overlaps the signal blocks N−1 and N, with the true occupancy indication signal $I_{N-1}$ and the true occupancy indication signal $I_N$ being provided, and the true $Q_{N-1}$ protection signal is moved into the N−1 signal block in relation to the occupancy indication signal $I_N$ for protecting the rear of the train. Note that the erroneous occupancy indication signal $I_{N+1}$ and the pseudo occupancy signal $B_{N+1}$ continue to be provided. In the fourth line of the table the train has moved completely into the signal block N such that the true protection signal $Q_{N-1}$ remains with the signal block N−1, with the erroneous true occupancy indication signal $I_{N+1}$ and the true pseudo occupancy signal $B_{N+1}$ still being provided. Because of the pseudo occupancy signal $B_{N+1}$, the train stops its automatic speed controlled movement and comes to a stop in the N signal block. Manual control of the train by the operator is required to now move the train into the N+1 block where it again sees normal speed code signals and may again proceed with automatic speed control operation. In the fifth line of the table the train position has moved completely into the signal block N+1, and because of the pseudo occupancy signal $B_{N+1}$ being present, the above set $Q_N$ equation (1) is not satisfied so the true protection Q signal remains with the signal block N−1 and because the protection signal $Q_N$ is false the protection signal $Q_{N-1}$ is not reset. The true occupancy indication signal $I_{N+1}$ is now correct although no change occurs in the state of $I_{N+1}$. The pseudo occupancy signal $B_{N+1}$ continues to be set true. The sixth line of the table illustrates the situation where the train position overlaps the signal blocks N+1 and N+2, such that the true occupancy indication signal $I_{N+2}$ is now provided as well as the true occupancy indication signal $I_{N+1}$ continues to be provided, and this satisfies the second part of the set $Q_N$ equation so the true protection $Q_N$ signal moves into the N signal block. This is only a transitional case, however, as the conditions for setting true the Q in signal block N+1 are now satisfied protective and the $Q_{N+1}$ signal is immediately set for signal block N+1, which is the final state shown in line 6 of the table. At the seventh line of the table the train enters the block N+3 so the true occupancy indication signal $I_{N+3}$ is provided as well as the true occupancy indication signal $I_{N+2}$ because the train now overlaps the block N+2 and block N+3. The set $Q_{N+2}$ equation is now satisfied so the true protection signal $Q_{N+2}$ is set and now appears in relation to the block N+2 and resets to false the protection signal $Q_{N+1}$ for the N+1 block. The reset $B_{N+1}$ equation (4) is not satisfied, since the true psuedo occupancy indication signal $I_{N+1}$ is still being provided. At the eighth line of the table the train is completely within the block N+3 so the occupancy indication signal $I_{N+2}$ is no longer provided and the true protection signal $Q_{n+2}$ remains with the N+2 signal block. At the ninth line of the table the train moves into the N+3 block and overlaps the block such that the true occupancy indication signal $I_{N+4}$ is provided to move the true protection $Q_{N+3}$ signal into the N+3 block and the true occupancy indication signal $I_{N+3}$ continues since a portion of the train remains in the N+3 block. At the tenth line of the table the train is totally within the block N+4, so the true occupancy indication signal $I_{N+4}$ is provided. The pseudo occupancy $B_{N+1}$ is reset false and not provided in relation to the line ten of the table to illustrate the situation where the error condition has been corrected such that the occupancy indication signal $I_{N+1}$ is no longer true and provided for the N+1 block when the train is not located within the N+1 block, and the above reset $B_{N+1}$ equation (4) now operates.

The above equation (7) for setting true the occupancy control signal 0, as shown in FIG. 2 in relation to signal $O_N$ applied to lead 29 operative with the speed encoder 13, includes the true occupancy indication signal I for the signal block under consideration, for example signal block N, the protection signal Q provided by the signal block logic circuit in relation to a train vehicle being present within the next succeeding block as indicated by the associated occupancy indication signal I and in addition the occupancy control signal 0 is determined in relation to the provision of the protection signal provided Q by the previous signal block logic circuit. In general, each train already occupies a signal block ahead of the set true protection Q signal being provided for the signal block immediately after the train. The above equation (5) for setting true the occupancy control signal $O_N$ required only an occupancy of the signal block N for providing the set true occupancy indication signal $I_N$ for latching the set true protection signal $Q_{N-1}$ in relation to the previous block N−1, which meant that if the detected train occupancy within a signal block should be lost for some reason, the particular train within the signal block N is protected from behind but it was not protecting itself. The latter protection of the train itself can become critical in relation to the operation of switches and the like within the occupied signal block N where it is necessary to know where the train is before a switch is operated. Thusly, where a set true protection signal $Q_{N-1}$ is provided for the block N−1 it can be reasoned that an occupancy indication signal $I_N$ must have been set true to move the protective Q signal into the block N−1 when the train moved into the signal block N, and therefore the set true protection signal $Q_{N-1}$ can be utilized to force a train occupancy within the signal block N for the purpose of protecting the train present within the signal block N in relation to switch operations within the signal block N. In general the detection of the train vehicle presence within a signal block where switching is desired should not be lost since the switch control logic for a given signal block senses a train occupancy in that signal block and prohibits switch operation when that given signal block is occupied. Thusly, the pseudo occupancy $B_N$ signal is operative to in effect look backward for determining the movement of the set true protection signal Q for protecting the rear of the train, and the inclusion within the above equation (7) of the set true protection Q signal for the previous block in effect protects the train occupying a signal block, such as signal block N, in relation to the switching and other operations within that signal block which might adversely affect the operation of the train within that signal block.

ADDITIONAL REAL TIME TRAIN CONTROL OPERATIONAL CONDITIONS OF INTEREST:

Several of the above equations may require some modification to meet the following special and practical operational conditions of a real time train speed control system.

A. System Entry
B. Forward Run Block Length Greater than Train Length
C. Forward Run Block Length Less than Train Length
D. Station Boundary Transition in Forward Direction
E. Station Stop
F. Turnback
G. Reverse Run
H. Station Boundary Transition in Reverse
I. System Exit
J. Special Re-initialization Since the yard master has visual protection for the transfer zone signal block for all train vehicle moves, it is not felt necessary to protect a train sitting in a transfer zone before being dispatched.

A. SYSTEM ENTRY

When a new train is desired to enter the main track system from a storage yard or siding as shown in FIG. 5, because of the more-or-less infinite application nature of the above set Q equation (1) and a set true protection signal Q is required behind the train for the protection of the train, a modified set Q equation is required in this situation to properly operate with the existing train control system.

The train is brought up manually to the transfer zone A from the repair and storage yard, and it is then transferred to automatic operation onto the main line when the main line track system is clear for entry of this train of vehicles.

The set true protection signal Q is put into the transfer zone A and it could then block any other trains coming into the track system through the transfer zone A as well as other trains leaving the track system through the transfer zone A.

The set true occupancy indication signal $I_A$ is present as the train enters the transfer zone A, but a protection signal Q is not set true in the transfer zone A at this time. When the set true occupancy indication signal $I_{A+1}$ is present in the next signal block A+1, then the set true protection signal $Q_A$ is entered into the transfer zone signal block A. Because these are normally short track circuit signal blocks, the set true occupancy indication signal $I_{A+2}$ is allowed to come up in signal block A+2 and then set true a protection signal $Q_{A+1}$ in signal block A+1. The set true protection signal $Q_A$ is still left in the transfer zone A because a protection signal Q remains behind the front of any train for at least 700 feet or 213.35 meters of track, and all of the signal block lengths including a Q protection signal are summed for this purpose since this is the predetermined maximum permitted train length that has to be protected. Then the protection Q signals are sequentially cancelled and set false behind the train as permitted in consideration of keeping at least this maximum permitted train length of set true Q signal protection at all times behind the front of the train.

When a set true occupancy indication $I_{A+1}$ is seen in signal block A+1, with the train commanded to move in a forward direction, a set true protection signal $Q_A$ is entered into signal block A, with no requirement for previous protection Q signals. The modified control algorithm relationship of above equation (1) is set $Q_A=(I_{A+1})$. NORTZ, where NORTZ is a logic signal indicating forward running is in operation. A normal speed code is provided for the A and A+1 signal blocks, so the train will move under automatic control after the train is manually brought into the transfer zone signal block A. The set true protection Q signals are a secondary protective operation in addition to the primary occupancy indication I signal control system.

The transfer zone block A includes logic gates such that a train will not leave the block A under automatic control until the yard master manually opens the logic gate leading into the next signal block A+1, and this depends upon forward occupancies in relation to other trains, mainline occupancies and so forth. It is desired here to avoid a pseudo occupancy, since without inserting the protective Q signal into the transfer zone signal block A when the train enters the transfer zone A, then when the train progresses to the successive signal block A+1, a set true occupancy indication signal $I_{A+1}$ would be provided and the above set B equation (6) would otherwise operate to stop the automatic train passage through signal block A+1 if there were no set true protective Q signal in block A behind the front of the train. The B signal is not permitted by the here provided procedure, whereby anytime a set true occupancy indication signal $I_{a+1}$ is sensed in signal block A+1 then a set true protective Q signal will be set in block A on the understanding this is a legitimate train. The normal pseudo occupancy signal B operation of above equation (6) is again permitted in relation to a set true occupancy indication signal $I_{A+2}$ in signal block A+2. The above set B equation (6) is prevented from operating such that the pseudo occupancy signals $B_A$ and $B_{A+1}$ are prevented from controlling the train operation, i.e., the set true occupancy in signal block A+1 will set a protective Q in signal block A and not a B signal in block A+1. On the other hand, if the set true occupancy indication signal $I_{A+2}$ appears in block A+2, without a Q signal in block A, then the B signal is set in block A+2. The normal operation of above set B equation (6) and above set Q equation (1) is provided in relation to a set true occupancy indication signal $I_{A+2}$ for signal block A+2.

Figure 6:
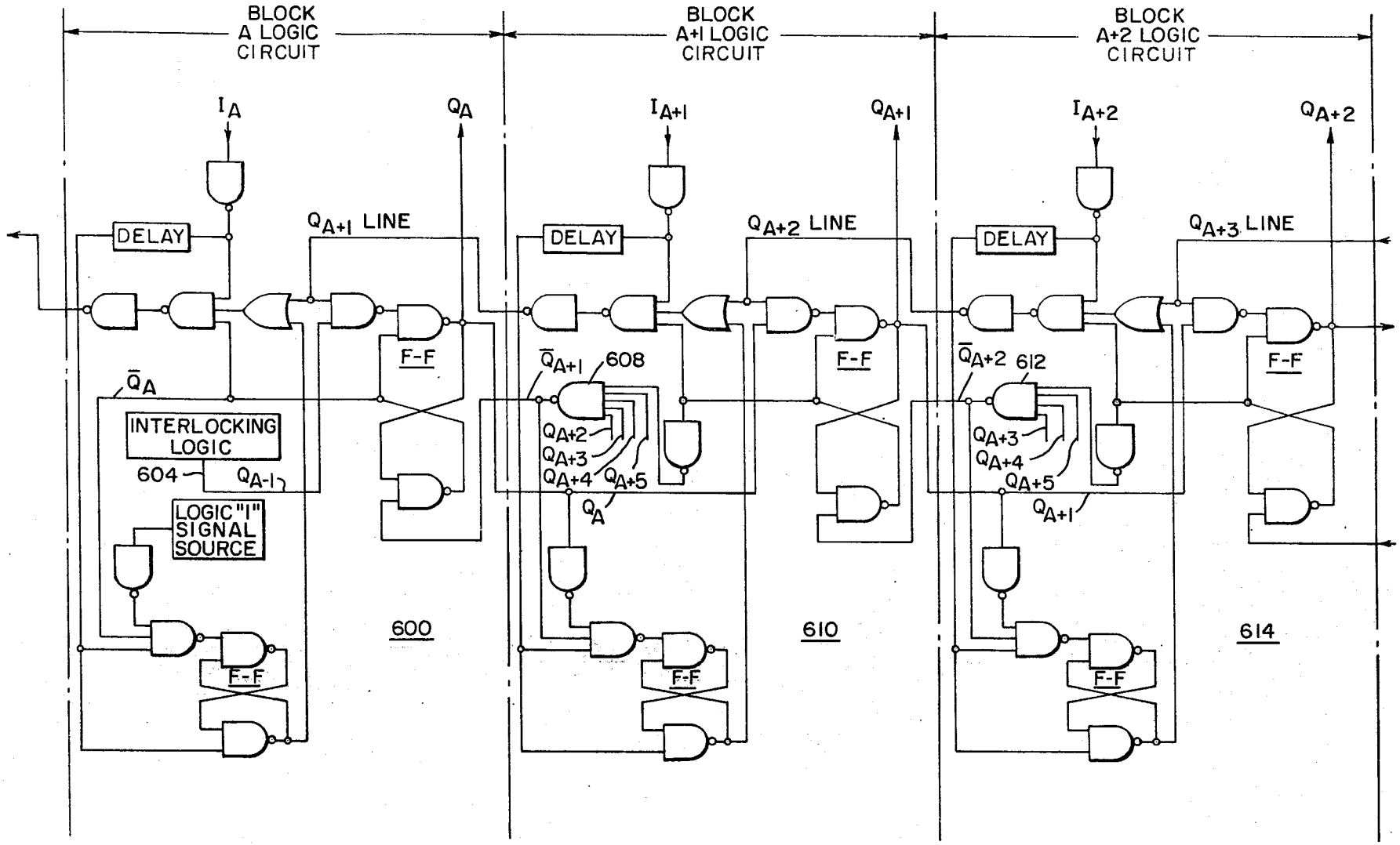
FIG. 6 illustrates the modified logic operation provided for signal blocks permitting system entry operation of a train onto the main track from a storage yard.

In FIG. 6 there is shown a modified logic operation permitting system entry of a train onto the main track from a storage yard. The logic circuit 600 operative with transfer zone signal block A, includes the NAND gate 602 for sensing the fictitious permanent one value protection signal $Q_{A-1}$ provided on conductor 604 when forward travel direction is set. The conductor 606 provides the set true $Q_{A+1}$ line signal which corresponds to the provision of the set true occupancy indication signal $I_{A+1}$ in accordance with the relationship $SQ_A = I_{A+1}$. The NAND gate 608 included in the logic circuit 610 operative with the signal block A+1 requires the provision of a plurality of protection Q signals, i.e., $Q_{A+2}$, $Q_{A+3}$, $Q_{A+4}$ and $Q_{A=5}$, before resetting protection signal $Q_A$, to in effect sum a plurality of the signal block lengths to provide more than 700 feet or 213.35 meters of protected track in relation to the predetermined maximum train length. The NAND gate 612 included in the logic circuit 614 operative with the signal block A+2 similarly requires the provision of a plurality of set true protection Q signals before resetting protection signal $Q_{A+1}$ to provide more than 700 feet or 213.35 meters of protected track in relation to the predetermined maximum train length.

The $Q_{A+1}$ and succeeding protection signals are set true by above equation (1) as previously described. The reset of $Q_A$ is provided by NAND gate 608 as here described. The pseudo occupancy indication signal $B_A$ for signal block A is set true by the relationship:

$$SB_A = 0 \qquad 9.$$

which is a modification of above equation (6) and the reset to false of this pseudo occupancy indication signal $B_A$ is determined by the relationship:

$$RB_A = 1 \qquad 10.$$

which is a modification of above equation (4), and is indirectly obtained in the given logic diagram by not setting $B_A$.

B. FORWARD RUN BLOCK LENGTH GREATER THAN TRAIN LENGTH

Figure 7:
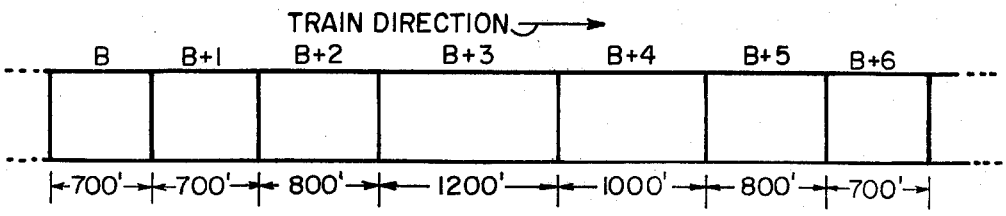
FIG. 7 shows an illustrative diagram of the track arrangement where some of the signal block lengths are greater than the determined maximum train length.

In FIG. 7 there is shown a track arrangement where some of the signal block lengths are greater than the determined maximum train length. The above set Q equation (1) and reset Q equation (2) are operative here. When a train enters signal block B+2, which is greater than the predetermined maximum length of 700 feet or 213.35 meters, a set ture occupancy indication signal $I_{B+2}$ is provided. A set true protection signal $Q_B$ is already present, since the train is moving in a direction from signal block B toward signal block B+6, so the above set Q equation (1) will extablish a set true protection signal $Q_{B+1}$. When the train moves up to signal block B+3, this produces a set true protection signal $Q_{B+2}$ and both set true occupancy indication signals $I_{B+2}$ and $I_{B+3}$ are present, and the signal $I_{B+3}$ pulls the protection signal $Q_{B+2}$ up into signal block B+2. The train is partially in block B+2, with a set true Q signal underneath the train to protect the train from behind. The train then moves fully into signal block B+3 and the signal $I_{B+2}$ disappears. The train progresses through each of the successive signal blocks in this manner. The logic circuit arrangement shown in FIG. 3 is utilized for this purpose.

C. FORWARD RUN SIGNAL BLOCK LENGTH LESS THAN TRAIN LENGTH

Figure 8:
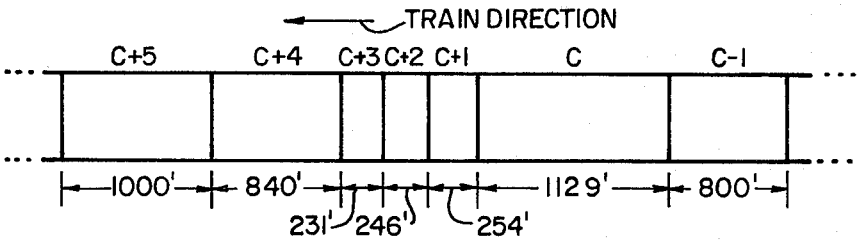
FIG. 8 shows an illustrative diagram of the track arrangement where some of the signal blocks have a length less than the determined maximum train length.

If the train can span two or more signal blocks, as shown in FIG. 8 where some signal blocks are less than 700 feet or 213.35 meters, it is necessary to change the resetting of the protection Q signals behind the train such that the overhanging tail of the train is not extending into a block without a Q protection signal still remaining in that latter block to protect the train. If the protection Q signal is brought up to the signal block behind the head of the train, as the normal operation of the above set Q equation (1) would do, this may leave a block behind the train unprotected and in which the tail of the train is still present.

The above reset Q equation (2) is modified since it may be desired to require a Q to be set true in two or more signal blocks ahead before resetting to false the protection Q in a given signal block.

The protection Q signal should be reset to false as soon as practical, since one or more additional occupancy signal blocks behind the train are now protected and this will hold up the headway of succeeding trains. The reset to false of $Q_C$ signal in reference to FIG. 8 could be determined by the set true provision signals of $Q_{C+1}$ and $Q_{C+2}$ and $Q_{C+3}$ and not $Q_{C-1}$. The reset to false of signal $Q_{C+1}$ can be determined by the provision of set true protection signals $Q_{C+2}$ and $Q_{C+3}$ and $Q_{C+4}$, and so forth. The reset to false of signal $Q_C$ is dependent upon multiple Q signals and a possible race condition is avoided by adding the term not $Q_{C-1}$, to assure that multiple resets occur from the rear forward.

Figure 9:
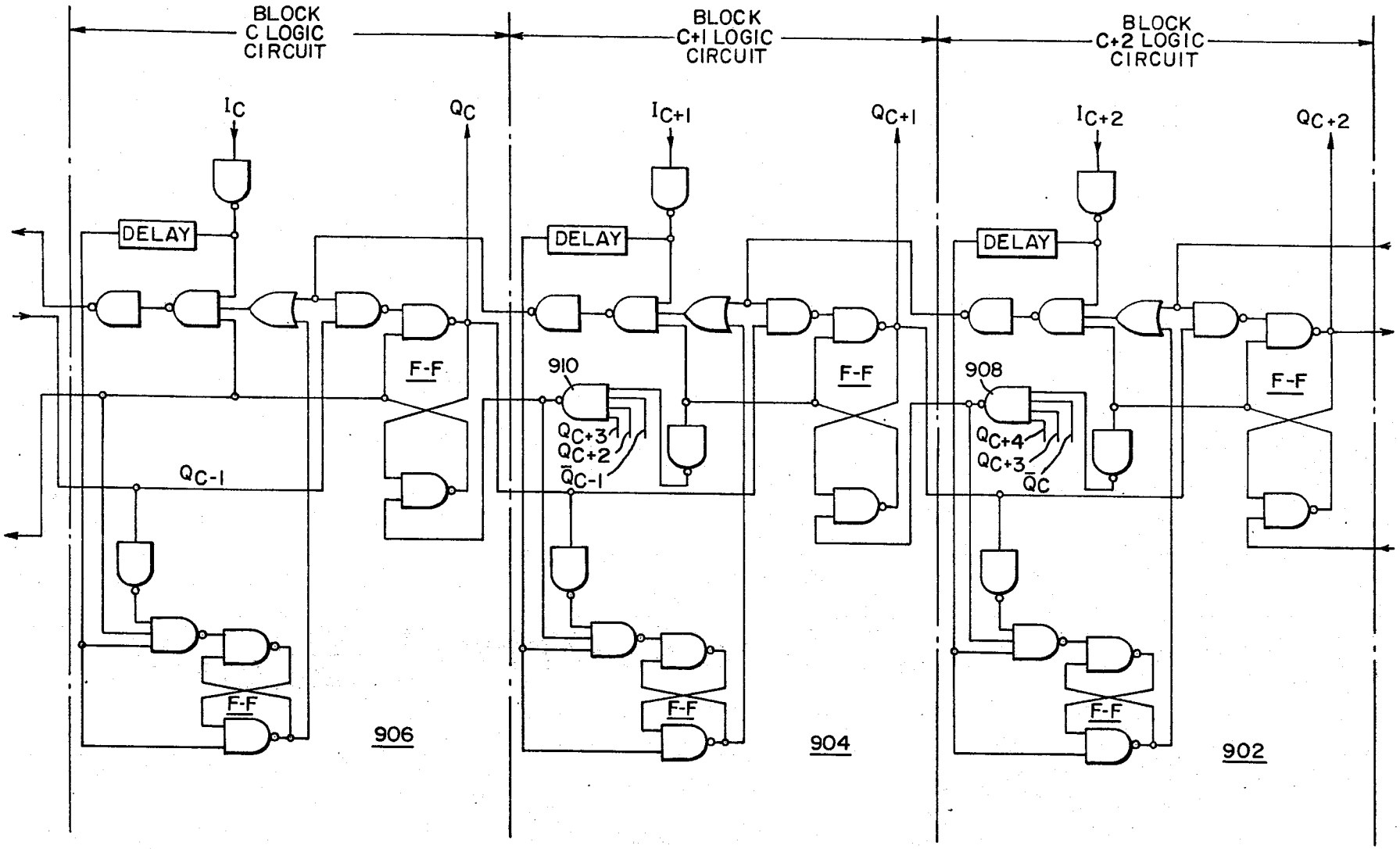
FIG. 9 illustrates the modified logic operation provided for signal blocks having either one of a length greater than or a length less than the determined maximum train length.

In reference to FIG. 9, the logic circuits 902, 904 and 906 are shown for respective signal blocks C, C+1 and C+2 shown in FIG. 8. The logic circuit 902 includes a NAND gate 908 operative to reset to false the protective signal $Q_{C+2}$ and responsive to the set true protection signals $Q_{C+3}$ and $Q_{C+4}$ and $Q_{C+2}$ in addition to the protective signal not $Q_C$ for this purpose. The logic circuit 904 includes a NAND gate 910 operative to reset to false the protective signal $Q_C$ and responsive to the set true protective signals $Q_{C+2}$, $Q_{C+3}$, and $Q_{C+1}$ in addition to the set false protective signal not $Q_{C-1}$. The logic circuit 906 resets the previous $Q_{C-1}$ in the normal manner given in FIG. 2 in response to the protective signal $Q_C$ since these previous block lengths are all longer than the maximum train length.

D. STATION BOUNDARY TRANSITION IN FORWARD DIRECTION

Figure 10:
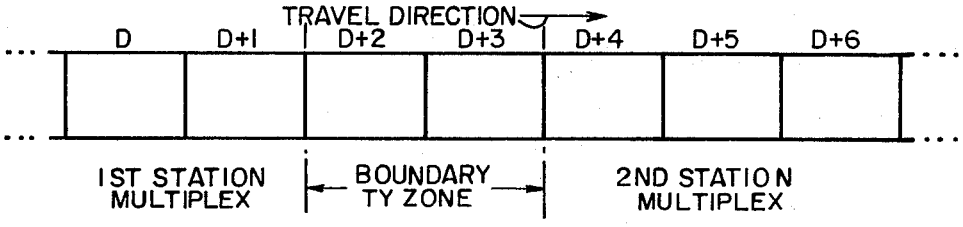
FIG. 10 shows an illustrative diagram of the track arrangement where a train vehicle moves through the boundary between one station multiplex and the next adjacent station multiplex.

In reference to FIG. 10, the signal blocks D+2 and D+3 are designated a station boundary, and set true train occupancy indication signals in these signal blocks D+2 and D+3 are combined through an OR operation to give one boundary occupation indication signal which is fed back to the previous signal block D+1 in the first station.

The above equation (1) for setting true a protective Q signal for the signal block D is modified as follows:

$$SQ_D = Q_{D-1}\,(Q_{D+1} \cdot I_{D+1}(B_{D+1} + \overline{TY}) \qquad 11.$$

and for the signal block D+1 is modified as follows:

$$SQ_{D+1} = Q_D \cdot \overline{TY} \qquad 12.$$

and the above equation (2) for resetting to false a protective Q signal for (2) block D+1 is modified as follows:

$$RQ_{D+1} = TY \qquad 13.$$

when the train has crossed the boundary including the signal blocks D+2 and D+3, a TY signal will be provided to the previous station 1 including the signal blocks D and D+1, when TY signal is present and there is no train occupancy in the boundary signal blocks D+2 and D+3. Thus the not signal TY or $\overline{TY}$ indicates there is a train occupancy in the boundary signal blocks D+2 and D+3 . . . Above equation (11) sets true a protective Q signal for signal block D when there is already a set true protective $Q_{D-1}$ signal and not a signal $Q_{D+1}$ and there is provided a set true occupancy indication signal $I_{D+1}$ for signal block D+1 and not a pseudo occupancy signal $B_{D+1}$ or there is not a TY signal. The above equation (12) sets true a protective $Q_{D+1}$ signal for signal block D+1 when there is a set true protective $Q_D$ signal and a TY occupancy indication signal ($\overline{TY}$) for boundary signal blocks D+2 and D+3. The above equation (13) resets to false the protective signal $Q_{D+1}$ when there is no longer an occupancy in the boundary signal blocks D+2 and D+3, and the train has moved into the signal block D+4, and the TY signal now becomes false.

The available information for the protective signal latching logic in the first station about the train occupancy of the second station is the occupancy of the boundary TY zone. Thusly, to assure that the protective signal $Q_{D+1}$ does not reset to false before the setting to true of the protective signal $Q_{D+2}$, the setting to true of the protective signal $Q_{D+2}$ will also be performed by the train occupancy of the boundary TY zone, as follows:

$$SQ_{D+2} = \overline{TY} \qquad 14.$$

Since the protective signal $Q_{D+2}$ is basically set true by $I_{D+2}$, no train occupancy should be implied in signal block D+3, so the above train occupancy control signal equation (7) is modified as follows:

$$Q_{D+2} = I_{D+3} + Q_{D+3} \qquad 15.$$

After the train has crossed the boundary signal blocks D+2 and D+3, the train control operation again utilizes the above equations, (1), (2), (4), (7) and (8) as previously described, with the protective $Q_{D+2}$ and $Q_{D+3}$ signals being reset to false by the set true protective $Q_{D+4}$ signal.

Any pseudo occupancy in the first station signal blocks D and D+1 will not influence the protective signal $Q_{D+1}$ since the latter signal is set true in accordance with above equation (12).

A pseudo occupancy in signal block D+3 will set the boundary occupancy signal $\overline{TY}$, which will set true protective signal $Q_{D+2}$ in accordance with above equation (14). A subsequent train will stop in the signal block D+1 and have to be manually moved through block D+1 and D+2 with a set true protective $Q_D$ set in block D. When the train enters block D+1 giving an occupancy indication of $I_{D+1}$, the conditions to set true protective signal $Q_{D+1}$ are met and the signal $Q_{D+1}$ operates to reset to false the signal $Q_D$, which could lose protection for the rear of the train sill extending into block D. To avoid this situation, the reset for protection signal $Q_D$ will be determined as follows:

$$RQ_D = Q_{D+1} \cdot (\overline{I}_D + B_D) \cdot (\overline{I}_{D+1} + B_{D+1}) \qquad 16.$$

After the first train has been manually moved to block D+3, that train can go to automatic train control operation through the signal blocks of the second station. However, since the pseudo occupancy in signal block D+3 is still present the boundary occupancy signal $\overline{TY}$ is still provided which prevents reset of $Q_{D+1}$ in accordance with equation (13). The next train will then stop in block D and have to be manually moved through signal blocks D+1 and D+2, and will leave a set true protective signal $Q_{D-1}$ in block D−1 previous to signal block D. To avoid an undesired stacking up of set true protective Q signals in this manner, the protective signal $Q_D$ will be set true as follows:

$$SQ_D = Q_{D-1} \cdot I_{D+1}\,(\overline{B}_{D+1} + \overline{TY}) \qquad 17.$$

such that when trains are manually moved through block D+1, the protective $Q_{D-1}$ signal will advance to block D and be reset by the protective signal $Q_{D+1}$ when occupancy indications $I_D$ and $I_{D+1}$ disappear.

Figure 11:
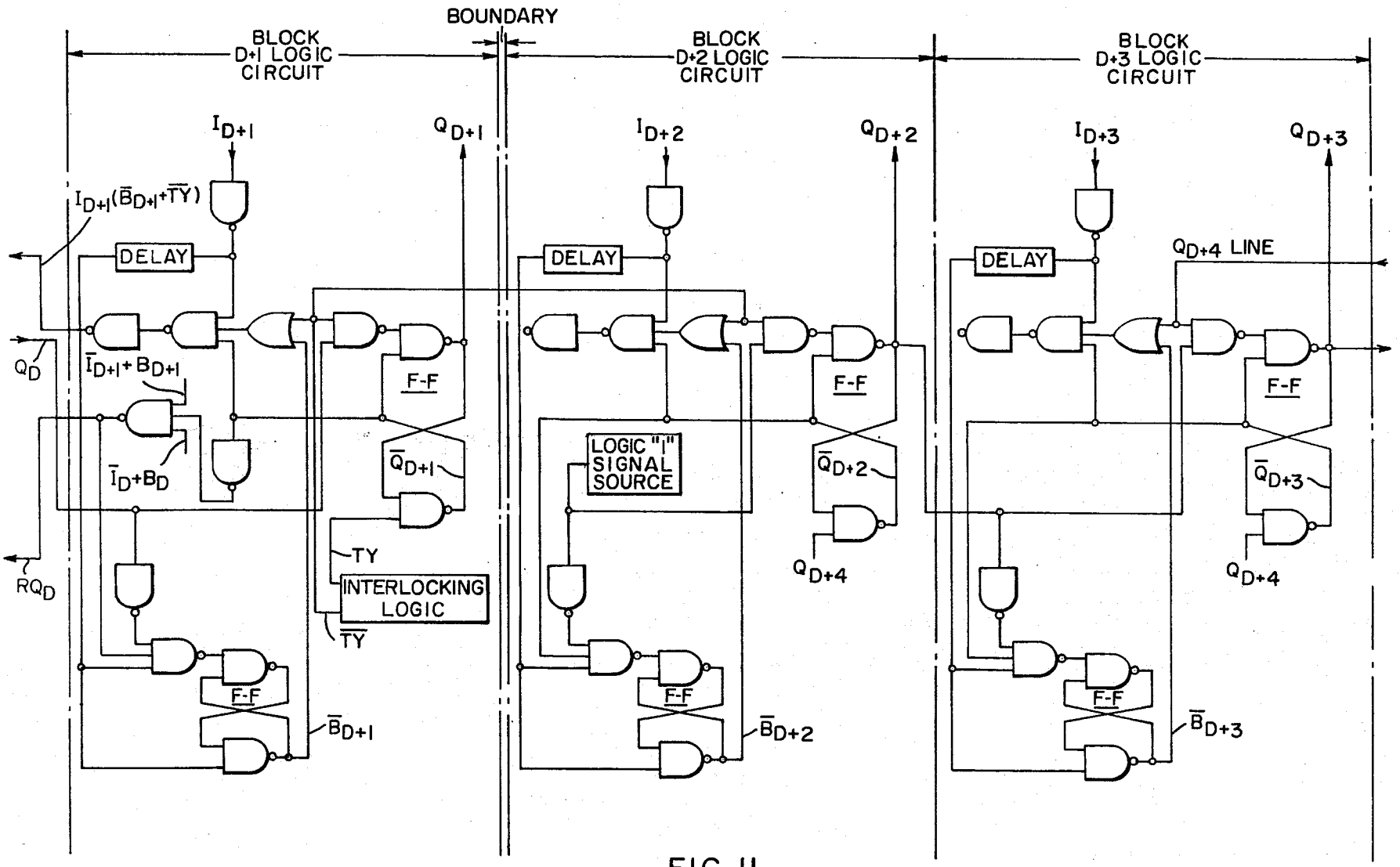
FIG. 11 illustrates the modified logic operation provided for signal blocks permitting a station boundary transition in the forward direction.

In FIG. 11 there is shown the modified logic operation provided for this purpose.

E. STATION STOP

Figure 12:
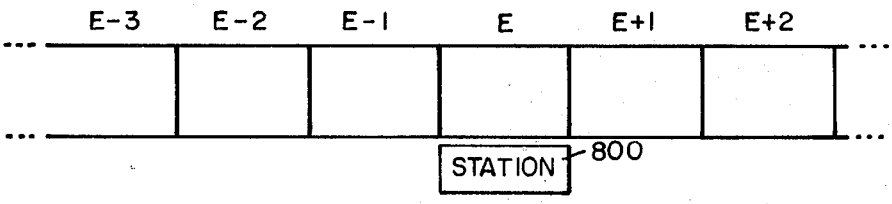
FIG. 12 shows an illustrative diagram of the track arrangement including a signal block operative with a station platform.

In FIG. 12 there is shown a platform 800 positioned adjacent to signal block E. To minimize the headway delay effect of stopping a train in signal block E, such that passengers can exit and enter by way of the platform 800, the door open signal, which is provided by the prior art wayside control system only when the train is correctly located without overhang in the platform signal block E, is utilized to move the latched protection Q signal under the train while the train is berthed at the station. This will reduce the headway restriction by the trailing protection Q signal behind the train. When the train pulls into station platform signal block E, there would otherwise be left at set true protection Q signal in signal block E−1 and subsequent trains would be held up by this apparent train occupancy in signal block E−1. When the train is completely within station platform signal block E, a door open control signal is provided by suitable position monitoring apparatus operative with the prior art wayside control apparatus. This door open signal DO is utilized in conjunction with the set true indicated occupancy signal $I_E$ for station block E to set a primed secondary latch protection signal $Q_E'$ as distinguished from the normal protection signal $Q_E$. Thusly, the protection signal $Q_{E-1}$ for the signal block just ahead of the station signal block is set true by above equation (1). The reset to false of protection signal $Q_{E-1}$ is determined by the following relationship:

$$RQ_{E-1} = Q_E + Q_E' \qquad 18.$$

The setting true of the secondary protection signal $Q_E'$ for the station signal block is determined by the following relationship:

$$SQ_E' = DO \cdot I_E \qquad 19.$$

While the reset of the secondary protection signal $Q_E'$ is determined by the relationship:

$$RQ_E' = SQ_E \qquad 20.$$

where the set $Q_E$ is the normal protection signal for the station signal block E. The setting of the normal protection signal $Q_E$ is determined by the relationship:

$$SQ_E = I_{E+1}\overline{Q}_{E+1}Q_E' + I_{E+1}Q_{E-1}\overline{Q}_{E+1}(\overline{B}_{E+1} + \overline{Q}_{E+2}I_{E+2} \cdot (\overline{B}_{E+2} \qquad 21.$$

The reset to false of the normal protection signal $Q_E$ is determined by above equation (2). The control signal $O_E$ for station signal block E is set true by the following relationship:

$$O_E = I_E + Q_E + Q_E' + Q_{E-1} \qquad 22.$$

while the occupancy control signal $O_{E+1}$ for the signal block E+1 is determined by above equation (7). It should be noted that above equations (18), (20) and reset of the normal protection signal $Q_E$ should be modified if a short signal block condition exists in relation to station signal block E.

The control signal equation in effect forces forward the set true train occupancy protection signal so as not to adversely influence the permitted speed code signal in the immediately previous signal blocks ahead of a following train. If there is a train positioned at the platform 800 in station signal block E and the secondary protection signal $Q_E'$ is brought under that train, it is not desired to let that protection signal $Q_E'$ force forward to influence the occupancy signal in the next succeeding signal block E+1, since this could otherwise result in a zero speed code being provided for the signal block E preceding signal block E+1, to prevent the train from leaving the station signal block E. Therefore, the secondary protection signal $Q_E'$ is utilized to indicate that a set true protection signal has been pulled up into the station signal block E and under the train in that station signal block E, and the set true protection signal $Q_{E-1}$ in the next previous signal block E−1 behind the train has been cleared. However, the secondary protection set true signal $Q_E'$ does not affect the train operation in the signal block E+1 ahead of the train.

Figure 13:
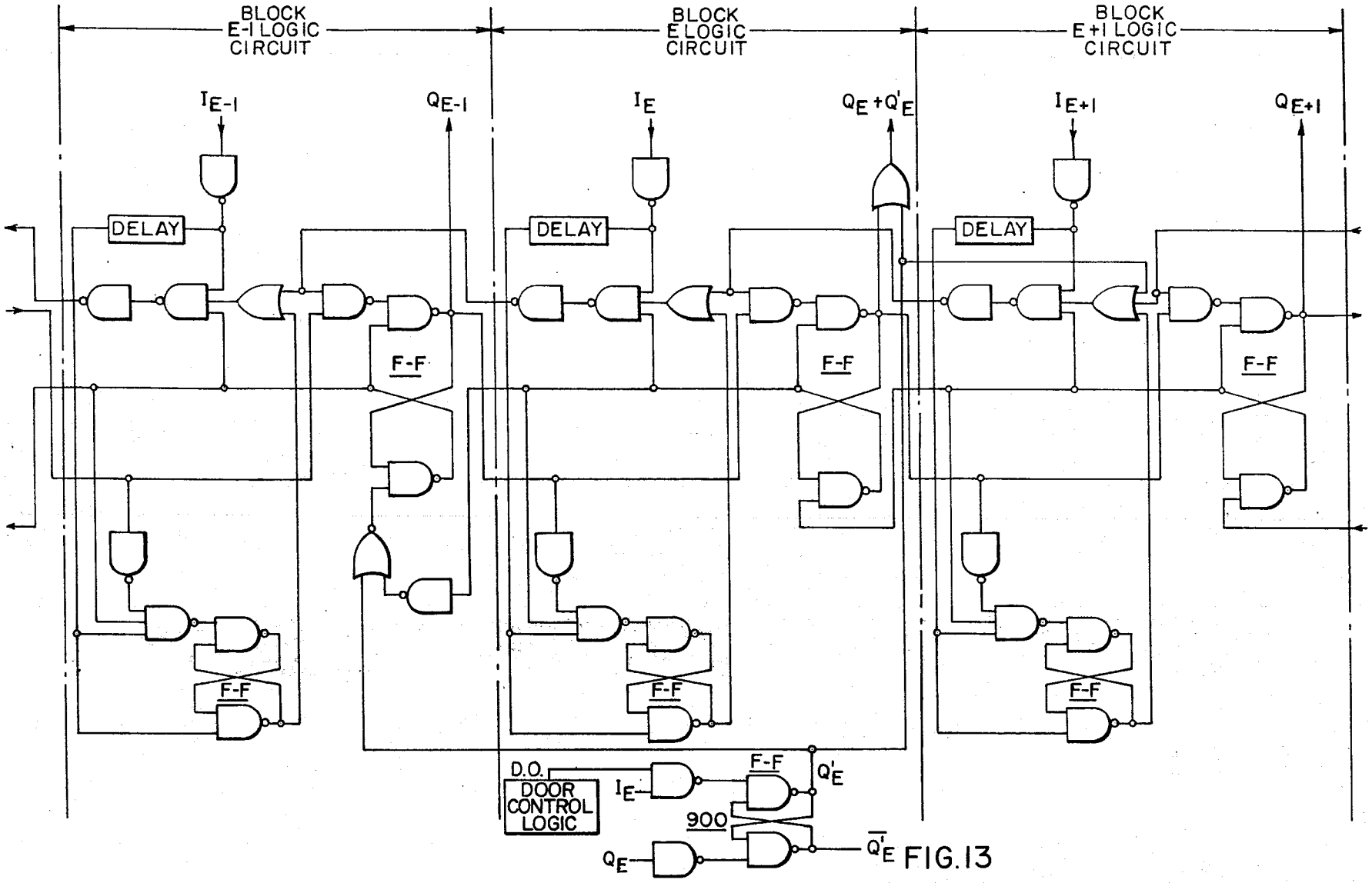
FIG. 13 illustrates the modified logic operation provided for a signal block operative with a station platform at which a train vehicle makes a stop.

In FIG. 13 there is shown the modified logic operation provided for this purpose. The flip-flop 900 operates with the door open signal DO and the set true occupancy indication signal $I_E$ to set and reset the secondary protection signal $Q_E'$. As the train leaves the station signal block E, the set true occupancy indication $I_{E+1}$ for the next signal block E+1 is provided and this shows that a normal set true protection signal $Q_E$ with its force forward influence can now be provided behind the train, so the normal protection signal $Q_E$ is set true by above equation (21) since there is present the set true occupancy indication signal $I_{E+1}$ and there is not set true protection signal $Q_{E+1}$ and there is present the set true secondary protection signal $Q_E'$. This sets true the normal protection signal $Q_E$ and resets false the secondary protection signal $Q_E'$ in accordance with above equation (20).

Figure 14:
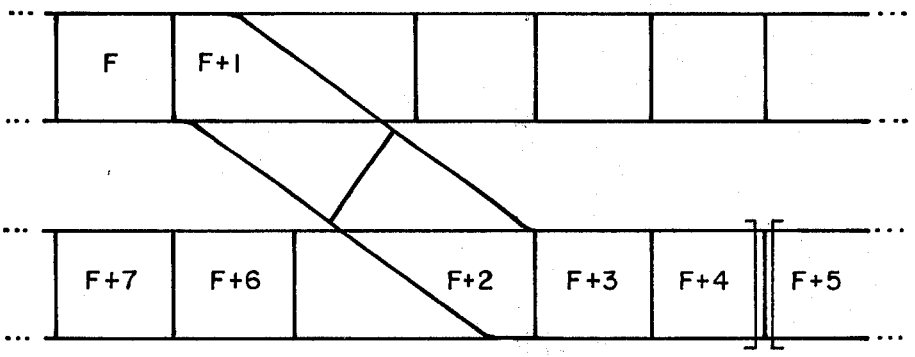
FIG. 14 shows an illustrative diagram of the track arrangement including provision for a turnback of a train of vehicles.

F. TURNBACK:

It is often desired for a train moving in a first direction along the track system to reach a predetermined signal block and then cross over to the opposite track and proceed back in the opposite direction. Since a set true protection signal Q is trailing the movement of a given train at all times, some procedure is required to pull this protection signal Q up under the train after the crossover so the train can reverse its direction back through a previous signal block that it has just come through and thereby have no interference with its own set true protective Q signal. In FIG. 14 there is shown the track system arrangement for permitting a train to effect a turnback operation, with a train moving from signal block F and through signal blocks F+1, F+2 and F+3 into signal block F+4. The latter signal block F+4 is the turnback signal block, where the train operator changes from what was the head end of the train to the previous rear end of the train. Upon reversal, the latter now becomes the head end for the opposite train direction. The turnback movement for the train will be from the top track shown in FIG. 14 moving from left to right, down through signal blocks F+1 and F+2 and into signal block F+3 and then into turnback signal block F+4. The train movement reversal takes place in signal block F+4, so the train can now move from right to left. First, the train has to move through signal block F+3, containing the protective Q signal. The set $Q'_{F+4}$ relationship is as follows:

$$SQ'_{F+4} = TMZ\ STOP \cdot I_{F+4} \cdot (\overline{I}_{F+1}\ \overline{I}_{F+2} \cdot etc) \cdot TIME \qquad 24.$$

X

Thusly, the set $Q'_{F+4}$ signal is determined by there being provided by the well known interlocking logic system a TMZ stop signal to indicate a desire for a turnback to occur, and a set true occupancy indication $I_{F+4}$, and not an occupancy indication $I_{F+1}$ and not an occupancy indication $I_{F+2}$ etc. in the crossover signal blocks. The TIME X signal provides a predetermined time delay (such as 2 minutes) since the occupancy indication $I_{F+4}$ can be momentarily lost, and enough time is desired for the train to travel about 800 feet and then stop to get clear of the interlocking crossover signal blocks F+1, F+2 and F+3 when the train is moving at about 6 MPH after starting this turnback operation.

The problem with setting true a protective Q signal under the train in the turnback block F+4 is that this protective signal cannot be used for the speed determining occupancy control signal $O_{F+4}$ for the first signal block F+3 upon exit from the turnback signal block F+4. Thusly, a secondary protective $Q'_{F+4}$ signal is established, using above equation (24). The setting of the protective signal for the other signal blocks will follow above equation (1). The reset to false of the secondary protective $Q'_{F+4}$ signal will be determined as follows:

$$RQ'_{F+4} = RQ_{F+4} \qquad 25.$$

and the setting true of the secondary protective signal $Q'_{F+4}$ will reset false all of the protective Q signals for the crossover signal blocks, F, F+1, F+2 and F+3. The setting true of the normal protective signal $Q_{F+4}$ will be determined by the following relationship:

$$SQ_{F+4} = (I_{F+3} \cdot \overline{Q}_{F+3} \cdot Q'_{F+4}) + \text{above equation 1.} \qquad 26.$$

The control signal $O_{F+4}$ will be set true by the relationship:

$$O_{F+4} = I_{F+4} + Q_{F+4} + Q'_{F+4} + Q_{F+5} \qquad 27.$$

where the protective signal $Q_{F+5}$ for the signal block F+5 is included since train moves can occur on both sides of the well known logic gate provided between signal blocks F+4 and F+5 when the gate is closed. The closing of this logic gate is employed to keep the protective Q signals separated for train moves on both sides of this logic gate. If the turnback signal block F+4 includes a station platform, then the setting of the secondary protective signal $Q'_{F+4}$ will include the door open control signal DO or a predetermined time delay, whichever occurs first. This time delay can be modified to allow for the required station stop profile operation rather than the predetermined turnback TM stop profile if desired.

When the train has stopped in the turnback signal block F+4 and it is desired to send the train back through signal block F+3 and in the opposite direction, this is sensed by a provided direction signal and is determined by there being provided either a set true occupancy indication $I_{F+3}$ and no set true normal protective signal $Q_{F+4}$ since there is now a set true secondary protective signal $Q'_{F+4}$ or a normal direction signal present.

The addition of the secondary protective signal $Q'_{F+4}$ with the above set Q equation (1) becomes effective as the train leaves the turnback signal block F+4 and enters the signal block F+3, when the normal protective signal $Q_{F+4}$ will be set. The secondary protective signal $Q'_{F+4}$ does not force forward, so only the normal protective signal $Q_{F+4}$ will be set true when the train enters signal block F+3 to to provide the set true occupancy indication $I_{F+3}$. The train is now receiving a normal speed code signal from the signal block F+3.

Figure 15:
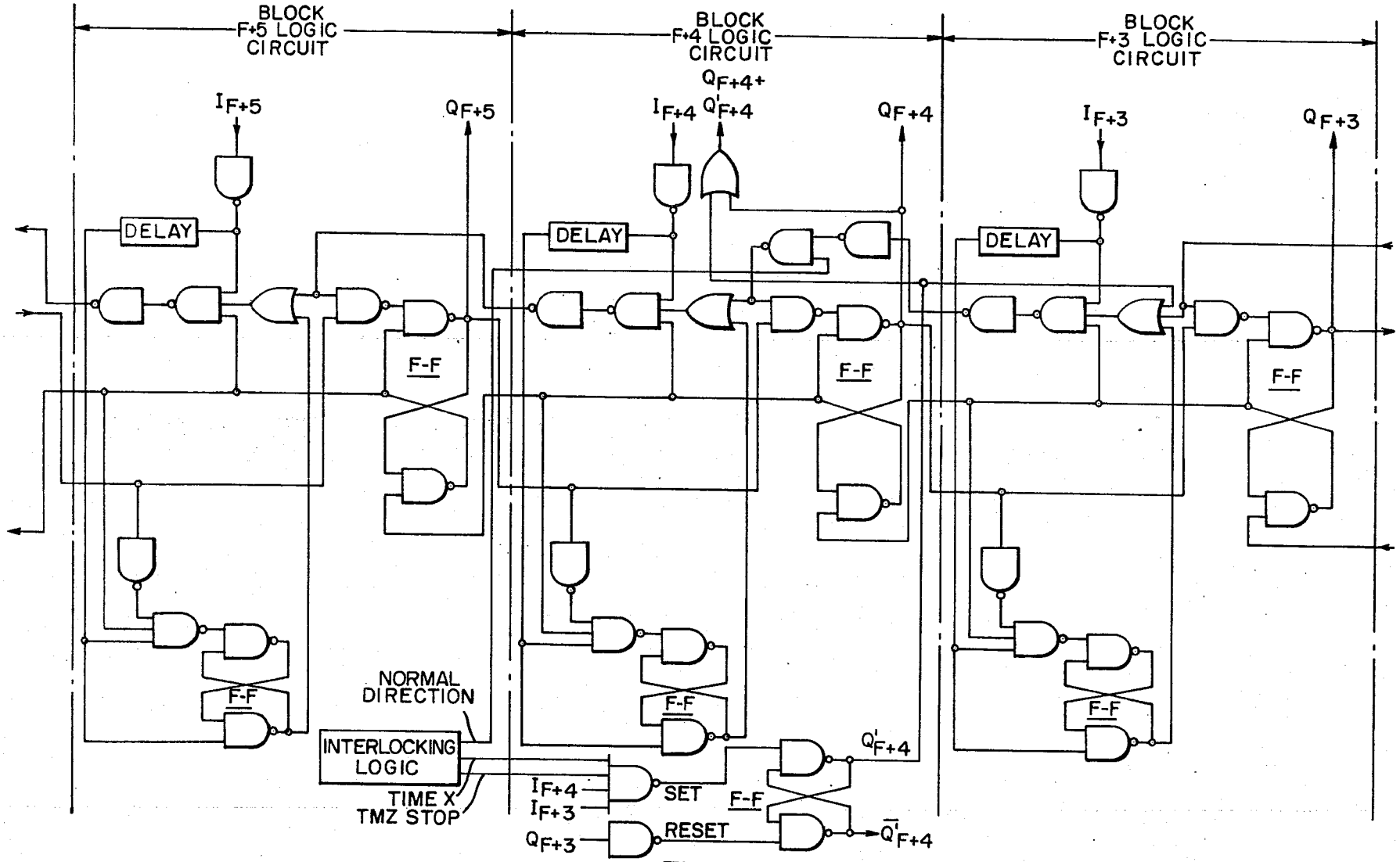
FIG. 15 illustrates the modified logic operation provided for signal blocks permitting a train turnback operation.

In FIG. 15 there is shown the modified logic operation for providing the above described turnback operation.

G. REVERSE RUN

A reverse run of a train will be treated the same as a forward run, since the setting of protective Q signals will progress as if all moves are normal.

H. STATION BOUNDARY TRANSITION IN REVERSE DIRECTION

The movement of a train crossing the station boundary between two stations is controlled substantially the same as for a train moving in a normal direction across a station boundary. The difference is that the transition zone length TZ sent back over the boundary will in general be longer as it should extend to the next interlocking. The protective Q signal set true by the occupancy indication TZD for a train within the transition zone will not be cleared until the train has moved completely into the next interlocking, since only one train is permitted between interlockings when in reverse run.

I. SYSTEM EXIT INTO YARD

Figure 16:
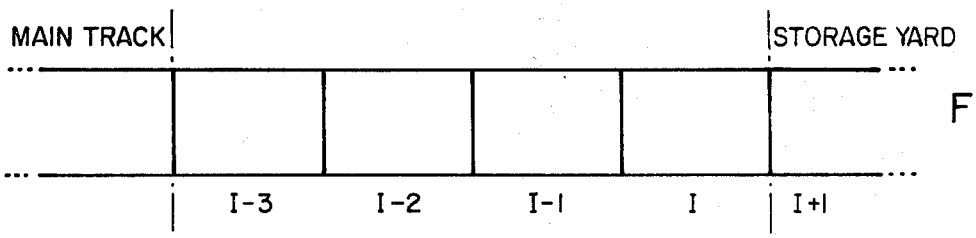
FIG. 16 shows an illustrative diagram of the track arrangement including provision for a train of vehicles to exit from the main track system, such as to a storage yard.
Figure 17:
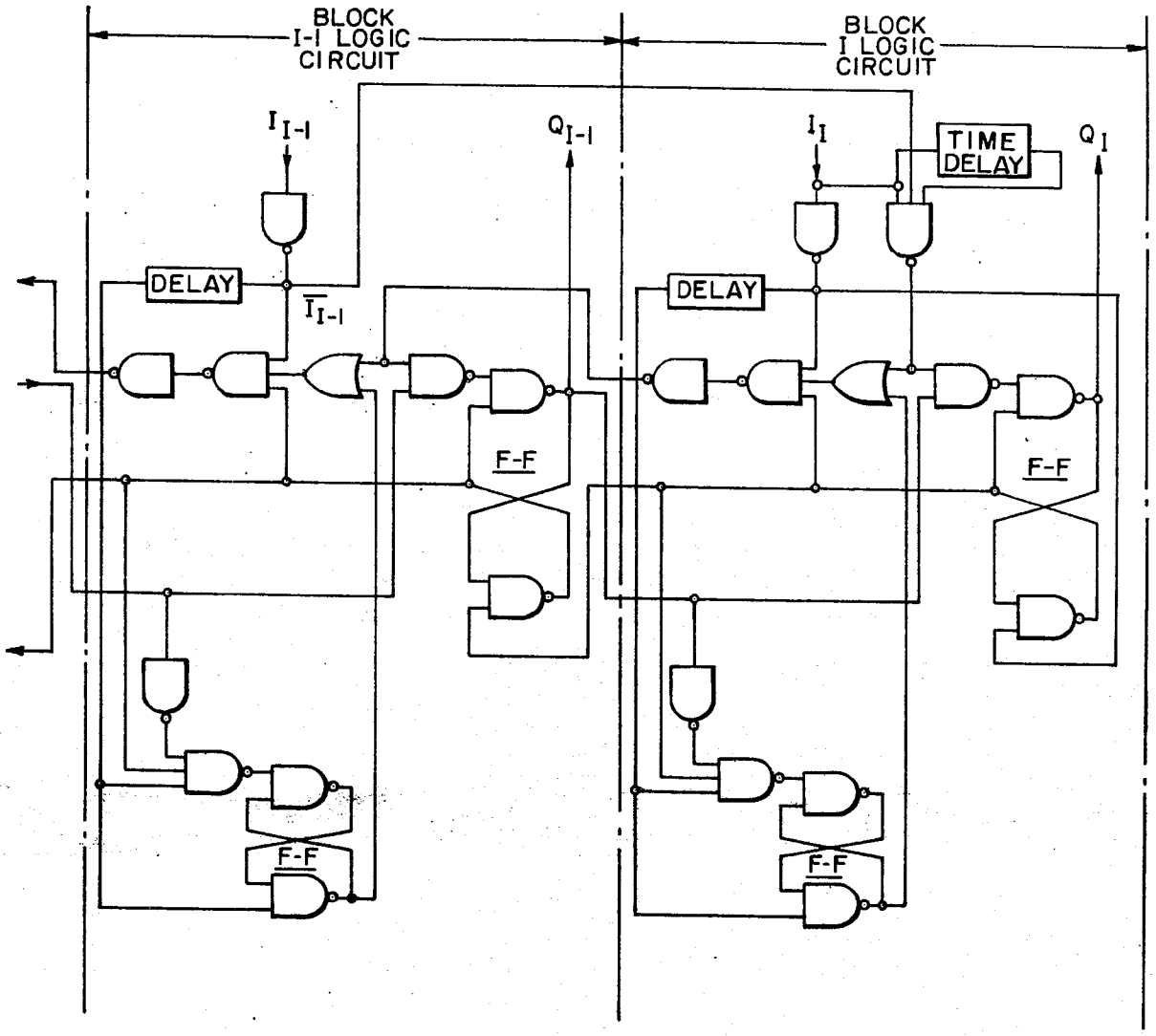
FIG. 17 illustrates the modified logic operation provided for the system exit of a train of vehicles.

In FIG. 16 a track connection between the main track and a storage or repair yard is shown, and includes a transfer zone signal block I and additional signal blocks I-1, I-2 and I-3. The problem is to eliminate the trailing set true protective Q signal behind the train. With the proper directional signal being present, then a predetermined time delay X after the train has entered the transfer zone I, if the transfer zone signal block I is still occupied and the previous signal blocks I-1, I-2 and I-3 are not occupied, the set true protective $Q_I$ signal will be moved up under the train. When the set true occupancy indication $I_I$ disappears or if a normal direction move is set up, the protective Q signal will disappear. FIG. 17 shows the logic diagram associated with such a move.

J. SPECIAL RE-INITIALIZATION

Figure 18:
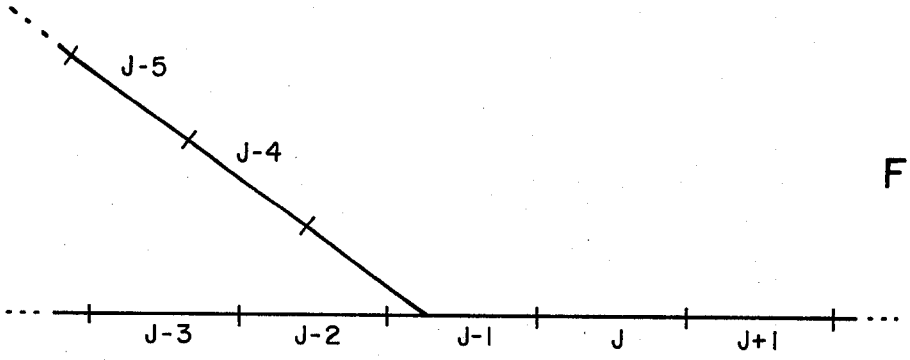
FIG. 18 shows an illustrative diagram of the track arrangement for the reinitialization desired of train protection in relation to merging trains at interlockings.

The above described special conditions A to I are effective to re-initialize the desired protective Q signals in relation to station boundaries and during station platform stops. In addition, desired protective Q signals will be re-initialized at normally used merges, where a train vehicle which has lost its trailing protective Q signal may expose itself to other train vehicle traffic merging from another track leg, so a set true protective Q signal is forced into the signal block immediately following the merge point by a train occupancy in the next track signal block. This is shown in FIG. 18, where a train occupancy in signal block J+1 will set true a protective $Q_J$ signal in signal block J immediately following the merge point.

Figure 19:
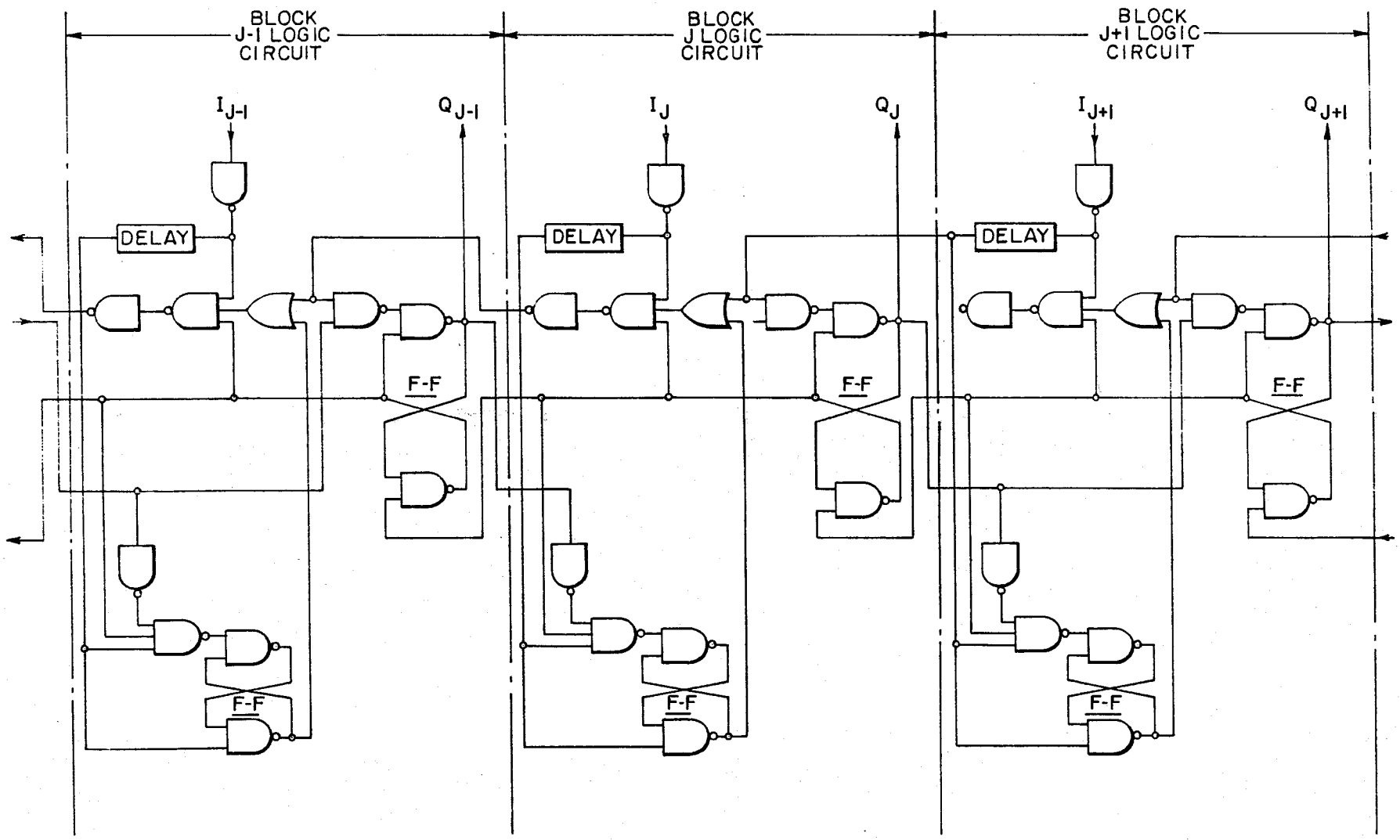
FIG. 19 illustrates the modified logic operation provided for the reinitialization of desired train protection in relation to a merge situation.

In FIG. 19 there is shown the modification of the logic circuit for signal block J required for the latter merge train vehicle control operation.

Figure 20:
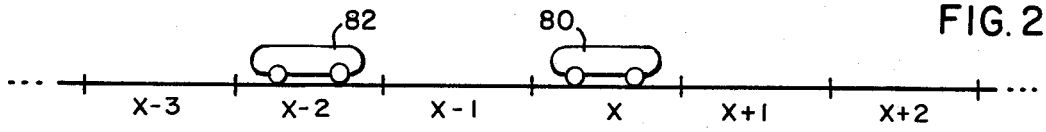
FIG. 20 illustrates the sequential occupancy release operation of the present invention.

In FIG. 20 there is shown a diagrammatic track arrangement to illustrate the sequential occupancy release train control operation provided by the present invention. When a first train 80 occupies and is detected in the signal block X, the occupancy indication signal $I_X$ is set true and this in turn sets true the protection signal $Q_{X-1}$ and the occupancy control signal $O_X$ which determines a zero speed code for signal block X−1. The protection signal $Q_{X-1}$ then sets true the occupancy control signal $O_{X-1}$ which determines a zero speed code for signal block X—2. Thusly, each of signal blocks X—1 and X—2 at this time is operative at a zero speed through the respective speed encoders. In accordance with the train control relationship provided by above equation (5) if $I_X$ should now become spurious or is lost, the first train 80 in signal block X is no longer detected in signal block X and the occupancy control signal $O_X$ will become false to no longer provide the zero speed code for signal block X—1 and instead there will return a normal speed code. A following second train 82 will stop in signal block X—2 since the set true protection signal $Q_{X-1}$ will still provide a zero speed code for the signal block X—2. The first train 80 may still be present in signal block X, even possibly stopped for some failure condition, and must be protected from the following second train 82. However, if for some reason such as a faulty operation of the second train vehicle brakes the second tran 82 should slide or pass through the signal block X—2 when the normal speed code has returned to signal block X—1 because of a spurious or lost occupancy indication signal $I_X$, the second train 82 would respond to this normal speed code in signal block X—1 and the first train 80 in the signal block X would no longer be protected in relation to this second train 82 for as long as the occupancy indication signal $I_X$ was not set true by a sensed first train 80 occupancy in signal block X.

In accordance with the train control relationship provided by the above equation (7) to illustrate the improved sequential occupancy release operation of the present invention, when the first train 80 occupies the signal block X, the occupancy indication signal $I_X$ is set true, and this in turn sets true the protection signal $Q_{X-1}$ and sets true the occupancy control signal $O_X$. The occupancy control signal $O_X$ determines a zero speed code for signal block X—1. The protection signal $Q_{X-1}$ sets true the occupancy control signal $O_{X-1}$ to determine a zero speed code for signal block X—2. Thusly, each of signal blocks X—1 and X—2 at this time is operative at a zero speed code. If the occupancy indication signal $I_X$ should now become spurious or is lost, the first train 80 is no longer detected in signal block X and the occupancy indication signal $I_X$ will become false. The occupancy control signal $O_X$ will remain true since in accordance with above equation (7) the protection signal $Q_{X-1}$ remains true so the zero speed condition for signal block X—will remain the same. The occupancy control signal $O_{X-1}$ will remain true because the protection signal $Q_{X-1}$ remains true, and this continues the zero speed condition for signal block X—1. The first train 80 may still be present in signal block X, and if it should slow down or stop for some reason, it must be protected for a following second train 82. Should the second train 82 for some reason slide or pass through the zero speed signal block X—2, the next signal block X—1 still continues a zero speed condition to protect the first train 80 in relation to the following second train 82.

Figure 21A:
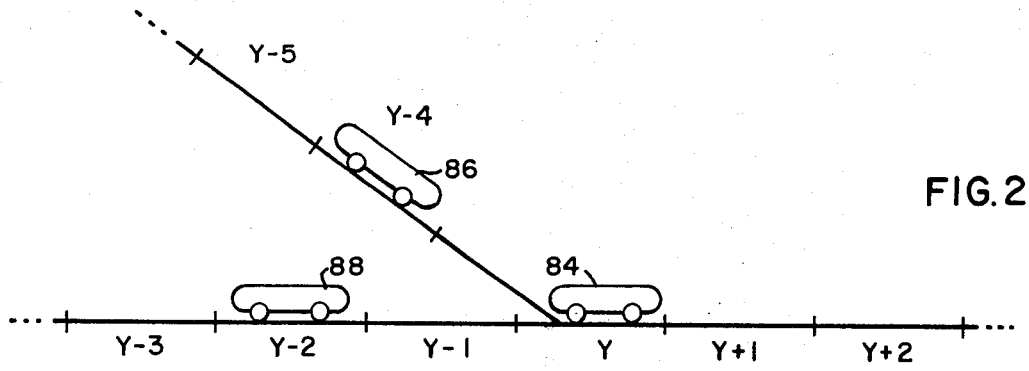
FIG. 21A illustrates the prior art sequential occupancy release operation in relation to a train vehicle merge situation.

In FIG. 21A there is shown a diagrammatic track arrangement to illustrate the prior art sequential occupancy release operation in relation to a train vehicle merge situation where a side track merges into the main track. The prior art switch control logic operative with the merge signal block Y does not sense the occupancy by the first train 84 in the signal block Y when the occupancy indication signal $I_Y$ is lost. This permits an approaching second train 86 on the side track to proceed into the merge block Y when the occupancy indication signal $I_Y$ is no longer true. Should the first train 84 actually still be in the merge block Y and the occupancy indication signal $I_Y$ is lost to become false, the prior art switch control logic for merge block Y would no longer cause a zero speed code in the side track signal block Y—4 to protect the first train 84 in relation to the second train 86 approaching on the side track. If a third train 88 were moving along the main track behind the first train 84, it would stop in signal block Y—2 as above described, since a zero speed code would continue for signal block Y—2 because of the set true protection signal $Q_{Y-1}$ even though the occupancy indication signal $I_Y$ were lost and became false.

Figure 21B:
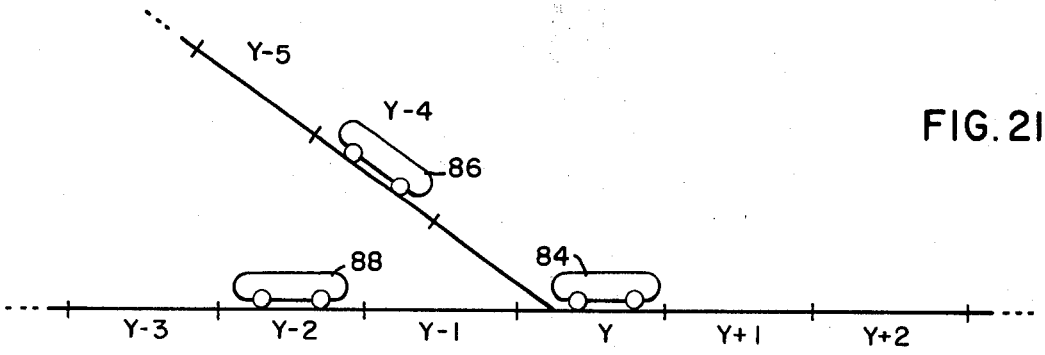

In FIG. 21B there is shown a diagrammatic track arrangement to illustrate the improved sequential occupancy release operation of the present invention in relation to a train vehicle merge situation. When the first train is detected in signal block Y to set true the occupancy indication signal $I_Y$, this sets true the occupancy control signal $O_Y$ and sets true the protection signal $Q_{Y-1}$ which sets true the occupancy control signal $O_{Y-1}$. The occupancy signal $O_Y$ operates to provide a zero speed code to signal block Y—1 and the occupancy control signal $O_{Y-1}$ operates to provide a zero speed code to signal block Y—2. If the occupancy indication signal $I_Y$ becomes spurious or lost, the occupancy control signal $O_Y$ remains true and the occupancy control signal $O_{Y-1}$ remains true. In accordance with the present invention as shown in FIG. 23, the interlocking logic including the switch control logic for signal block Y is made responsive to the occupancy control signal $O_Y$ instead of the occupancy indication signal $I_Y$, then when the first train 84 is still present in signal block Y and the occupancy indication signal $I_Y$ becomes spurious and false, the desired protection for the first train 84 is maintained in relation to a second train 86 approaching on the side track.

It is known by persons skilled in this art how the well known interlocking logic and switch control systems per se operate, since these have been generally operational with train vehicle control systems for many years.

It should be understood in relation to the illustration of FIG. 21B, that the occupancy control signal 0 is applied to the interlocking logic for only those blocks around switches, gates and so forth, and not all block occupancy indication signals and occupancy control signals throughout a train control system need be applied to interlocking.

In FIG. 22 there is illustrated the functional equivalency between well known negative logic OR devices, the combination of two series connected NAND devices and positive logic AND devices. It is believed to be routine knowledge of persons skilled in this art to select a particular one of a negative logic operation or a positive logic operation for the practical application of the control method and apparatus for train vehicles of the present invention.

In FIG. 23 there is illustrated a programmed digital control computer system operative for controlling the movement of a train vehicle in accordance with the present invention. The here-included program listing is operative with such a digital control computer system to provide the desired control method and apparatus operation for train vehicles of the present invention.

GENERAL DESCRIPTION OF INSTRUCTION PROGRAM LISTING

There is included an instruction program listing that has been prepared to control the movement of one or more train vehicles coupled together to form a train in accordance with the here-disclosed control method and apparatus. The instruction program listing is written in the machine language of the LSI 2 digital computer system, which is sold at the present time by Computer Automation Corporation for real time process control computer applications. Many of these digital control computer systems have already been supplied to customers, including customer instruction books and descriptive documentation to explain to persons skilled in this art the operation of the hardware logic and the executive software of this digital control computer system. This instruction program listing is included to provide an illustration of one suitable software embodiment of the present control method and apparatus that has actually been prepared. This instruction program listing at the present time has not been extensively debugged through the course of practical operation for the real time control of a train movement control system. It is well known by persons skilled in this art that most real time process control application programs contain some bugs or minor errors, and it is within the skill of such persons and requires varying periods of actual operation time to identify and correct these bugs.

The instruction program listing includes the following routines:

| TITLE | PAGES |
|---|---|
| COMMON DATA | A-1 to A-4 |
| SCHEDULER | B-1 to B-4 |
| INPUT AND FILTER | C-1 and C-2 |
| CHANGE AND DIRECTION | D-1 to D-4 |
| WALK | E-1 to E-7 |
| EQUATION SCHEDULER | F-1 to F-7 |
| SET Q | G-1 to G-8 |
| RESET Q | H-1 to H-5 |
| MISCELLANEOUS UTILITIES | 4725A38 J-1 and J-2 |
| OUTPUT | K-1 to K-3 |
| DIAGNOSTICS | L-1 to L-4 |

In addition pages M-1 to M-10 illustrate a track plan established for a station including a terminal zone and end of the line applications. The pages N-1 to N-26 illustrate a track plan established for a storage yard, including system entry and system exit applications. The pages P-1 to P-26 illustrate a track plan established for a station including a large and complex station, a merge and platform stop applications.

This instruction program listing included in the Appendix was prepared in relation to the logic diagrams shown in FIGS. 3, 6, 9, 11, 13, 15, 17 and 19.

What we claim is:

1. In apparatus for controlling the speed of a plurality of train vehicles along a track including a plurality of signal blocks, the combination of means for providing an occupancy indication signal in relation to the sensed occupancy of a first signal block by one of said train vehicles, means for providing a first protection signal in response to said occupancy indication signal, and means for providing an occupancy control signal in response to the provision of said occupancy indication signal and in response to said first protection signal to determine a zero speed code for a second signal block previous to said first signal block.

2. The apparatus of claim 1, with said occupancy control signal being operative to control the speed of another train vehicle in relation to said second signal block.

3. The apparatus of claim 1, with said first signal block being signal block N, with said second signal block being signal block N−1, and with said first protection signal being operative to determine the speed code supplied to second signal block N−1.

4. The apparatus of claim 1, with said first protection signal being operative with said second signal block for protecting said first vehicle in relation to the movement of said second train vehicle in said second signal block.

5. The apparatus of claim 1, with said first protection signal being operative with a third signal block previous to said second signal block to determine a vehicle speed code for said third signal block.

6. The apparatus of claim 1 operative with a source of a forward direction signal, with said first protection signal being provided in response to said occupancy indication signal and said forward direction signal when said one train vehicle begins to move along said track.

7. The apparatus of claim 1 operative with a source of a forward direction signal, and including means for providing at least a second occupancy indication signal in relation to the sensed occupancy by said one train vehicle of an additional signal block ahead of said first signal block, means for providing a second protection signal in response to said second occupancy indication signal and said first protection signal, and means for providing a pseudo occupancy signal in relation to said additional signal block in response to said second occupancy indication signal in relation to the provision of said first protection signal.

8. The apparatus of claim 1, with said first protection signal being set in response to said occupancy indication signal, and with said first protection signal being reset in relation to a predetermined maximum length of a train of said train vehicles.

9. The apparatus of claim 8, with the reset of said first protection signal in relation to said second signal block being established in a predetermined sequential relationship with the reset of protection signals for other signal blocks of said track.

10. The apparatus of claim 1 operative with a source of a door open control signal, and including means for providing a secondary protection signal in response to said occupancy indication signal and said door open control signal.

11. The apparatus of claim 1 operative with a source of a door open control signal when said one train vehicle is positioned within a station platform signal block, and including means for providing a secondary protection signal in relation to said station platform signal block in response to said occupancy indication signal and said door open control signal.

12. The apparatus of claim 1 operative with a source of a turnback signal in relation to said first signal block being a turnback signal block of said track, and including means for providing a secondary protection signal in relation to said first signal block in response to said occupancy indication signal and said turnback signal, and means for resetting said first protection signal in response to the provision of said secondary protection signal.

13. The apparatus of claim 12, with said secondary protection signal providing means being responsive to a predetermined time delay in accordance with the movement of said one train vehicle into said first signal block.

14. The apparatus of claim 1 operative with a source of a direction signal and with said first signal block being a transfer zone signal block, with said means for providing a first protection signal being responsive to said direction signal and in relation to said first signal block.

15. The apparatus of claim 1 operative with a source of a direction signal and with said first signal block being a transfer zone signal block, and including means for providing a secondary protection signal in response to said direction signal and said occupancy indication signal and in accordance with the occupancy of a predetermined number of previous signal blocks of said track, and means for resetting said secondary protection signal when said occupancy indication signal is no longer provided.

16. The apparatus of claim 1 with said first signal block being in a main track including a switch and being located in relation to a merge side track and operative with switch control apparatus, and including means operative with said switch control apparatus and responsive to said occupancy control signal for determining the operation of said switch with said main track for as long as said occupancy control signal is provided.

17. The apparatus of claim 16, with said occupancy control signal $O_N$ being determined by the relationship $$O_N = I_n \text{ or } Q_N \text{ or } Q_{N-1}$$

where $O_N$ is related to the occupancy of first signal block N by said one train vehicle, where $I_N$ is said occupancy indication signal for first signal block N, where $Q_{N-1}$ is said first protection signal provided in relation to second signal block N−1 previous to said first signal block N, and where $Q_N$ is a second protection signal provided in relation to said first signal block N.

18. In the method of controlling the movement of a second train vehicle following a first train vehicle along a track including a plurality of signal blocks, the steps of providing at least an initial occupancy indication signal in relation to the occupancy of a first signal block by said first train vehicle, providing a predetermined protection signal in relation to said first train vehicle in response to said initial occupancy indication signal, and controlling the movement of said second train vehicle in relation to a second signal block previous to said first signal block in response to the provision of said occupancy indication signal and in response to said predetermined protection signal.

19. The method of claim 18, including the step of providing an occupancy control signal in accordance with the provision of said occupancy indication signal and said predetermined protection signal for controlling the movement of said second train vehicle by determining a zero speed code in relation to said second signal block.

20. The method of claim 18 with said predetermined protection signal continuing to be provided regardless of the provision of said occupancy indication signal, and with said movement of said second train vehicle being controlled in relation to said second signal block in response to said predetermined protection signal.

21. The apparatus for controlling the movement of at least one train vehicle operative with a track including a plurality of signal blocks, the combination of means for supplying a speed code to a first signal block, means for receiving said speed code from said first signal block, means operative with said supplying means and with said receiving means for providing an occupancy indication signal in relation to the occupancy of said first signal block by said one train vehicle, means responsive to said occupancy indication signal for providing a protection signal, and means responsive to said occupancy indication signal and said protection signal for providing an occupancy control signal to determine the speed code supplied to a second signal block previous to said first signal block in relation to the movement of said one train vehicle.

22. The apparatus of claim 21, with said first signal block being signal block N and with said second signal block being the next previous signal block N−1.

23. The apparatus of claim 21, with said occupancy indication signal being occupancy indication signal $I_N$ in relation to first signal block N, with said protection signal being protection signal $Q_{N-1}$ in relation to the previous second signal block N−1, and with said occupancy control signal being occupancy control signal $O_N$ operative to determine the speed code supplied to second signal block N−1.

24. The apparatus of claim 21, including means responsive to said protection signal for providing a second occupancy control signal to determine the speed code supplied to a third signal block previous to said second signal block in relation to the movement of said one train vehicle.

25. The apparatus of claim 21, with said first signal block being signal block N, with said second signal block being signal block N−1, and including means responsive to said protection signal for providing a second occupancy control signal to determine the speed code supplied to a third signal block N−2 previous to said second signal block N−1 in relation to the movement of said one train vehicle.

26. The apparatus of claim 21, with said occupancy control signal being provided by the relationship $$O_N = I_N + Q_N + Q_{N-1}$$

where $O_N$ is said occupancy control signal, where $I_N$ is said occupancy indication signal, where $Q_{N-1}$ is said protection signal provided in response to said occupancy indication signal, and where $Q_N$ is another protection signal provided in relation to said first signal block N.

27. The apparatus of claim 21, including means for providing a second protection signal in response to the occupancy of an additional signal block by a second train vehicle ahead of said one train vehicle.

28. The apparatus of claim 27, with said occupancy control signal being provided by the logic relationship set $O_N$ equal to $I_N$ or $Q_N$ or $Q_{N-1}$, where $O_N$ is provided when set as said occupancy control signal, where $I_N$ is said occupancy indication signal, where $Q_N$ is said second protection signal and where $Q_{N-1}$ is said protection signal provided in response to said occupancy indication signal.

* * * * *